US005759758A

United States Patent [19]

Yamazaki et al.

[11] Patent Number: 5,759,758

[45] Date of Patent: Jun. 2, 1998

[54] SILVER HALIDE PHOTOGRAPHIC MATERIAL

[75] Inventors: Kazuki Yamazaki; Shoji Yasuda, both of Kanagawa, Japan

[73] Assignee: Fuji Photo Film Co., Ltd., Kanagawa, Japan

[21] Appl. No.: 630,583

[22] Filed: Apr. 10, 1996

[30] Foreign Application Priority Data

| | | | |
|---|---|---|---|
| Apr. 10, 1995 | [JP] | Japan | 7-84208 |
| Apr. 10, 1995 | [JP] | Japan | 7-107817 |
| Apr. 10, 1995 | [JP] | Japan | 7-107837 |

[51] Int. Cl.[6] ..... G03C 1/06; G03C 1/09; G03C 1/34

[52] U.S. Cl. ..... 430/567; 430/604; 430/605; 430/607; 430/612

[58] Field of Search ..... 430/604, 605, 430/607, 612, 567

[56] References Cited

U.S. PATENT DOCUMENTS

| | | | |
|---|---|---|---|
| 4,681,836 | 7/1987 | Inoue et al. | 430/434 |
| 4,722,884 | 2/1988 | Inoue et al. | 430/446 |
| 5,478,715 | 12/1995 | Ohzeki et al. | 430/567 |

FOREIGN PATENT DOCUMENTS

| | | | |
|---|---|---|---|
| 0488601 A1 | 6/1992 | European Pat. Off. | G03C 1/09 |
| 0488737 A1 | 6/1992 | European Pat. Off. | G03C 1/09 |
| 0 573 066 | 12/1993 | European Pat. Off. . | |
| 0658802 A2 | 6/1995 | European Pat. Off. | G03C 1/09 |
| 6-59375 | 3/1994 | Japan . | |
| 6-59376 | 3/1994 | Japan . | |
| 6-208185 | 7/1994 | Japan . | |
| 6-258754 | 9/1994 | Japan . | |
| 6-258755 | 9/1994 | Japan . | |

*Primary Examiner*—Mark F. Huff

*Attorney, Agent, or Firm*—Sughrue, Mion, Zinn, Macpeak & Seas, PLLC

[57] ABSTRACT

A silver halide photographic material comprising a support having provided thereon at least one silver halide emulsion layer, wherein the silver halide emulsion comprises silver halide grains having a silver chloride content of 50 mol % or more, and the silver halide grain contains a cyanochromium complex ion represented by the following formula (I) and at least one complex of a metal selected from rhodium, ruthenium, osmium, rhenium and iron:

$$[Cr(CN)_{6-n}L_n]^{m-} \quad (I)$$

wherein L represents $H_2O$ or OH; n represents 0 or 1; and m represents 3 or 4.

11 Claims, No Drawings

SILVER HALIDE PHOTOGRAPHIC MATERIAL

FIELD OF THE INVENTION

The present invention relates to a silver halide photographic material. More specifically, the present invention relates to a silver halide photographic material for use in the photomechanical process.

BACKGROUND OF THE PRESENT INVENTION

The photomechanical processing using a silver halide photographic material comprises a step for converting an original having a continuous tone value into a halftone image, more specifically, for converting a density variation having a continuous tone value into an aggregate of dots each having an area in proportion of the density, so-called a halftone image; a step for scanning the original image using a scanner to convert the image signal into dots to thereby form a halftone image on a photographic material; and a step for converting the halftone image obtained in the previous step into a halftone image having better sharpness, namely a dot-to-dot working step. The photographic material used in this process is required to provide a high contrast in view of need for obtaining a good halftone dot quality.

Also, a high-sensitive photographic material is required for reduction in the processing time and high resolution in the above-described halftone image forming step and scanning step and prolongation of the life of light source.

Furthermore, the photographic material used in scanning is required to have various properties. Particularly, since the exposure time is short as from $10^{-3}$ to $10^{-8}$ second, it is essential that the photographic material exhibits high sensitivity and high contrast under such conditions.

On the other hand, a system using nucleation infectious development of a hydrazine compound is widely known for obtaining a high contrast image. When a specific acylhydrazine compound is incorporated into a surface latent image-type silver halide photographic material, an ultrahigh contrast negative image having a $\gamma$ (gamma) value exceeding 10 can be formed. The system may surely achieve formation of an ultrahigh contrast image; however, it is still deficient in that the photographic capabilities are relatively prone to change upon fluctuation in the developer composition. For example, upon increase in the pH or decrease of sulfite ions, the sensitivity may increase or black peppers (black spots) may be generated; or upon lowering in the pH or reduction in the developing agent, the sensitivity may be reduced or the contrast may be lowered. The black pepper is a black spot formed by fine developed silver generated on the portion which is unexposed and should be in fact a non-image area. A large number of black peppers are generated because of reduction in the sulfite ions used as a preservative in the developer or increase in the pH value, which gives rise to serious reduction in the commercial value as a photographic material for photomechanical process. Accordingly, it has been demanded to stably obtain a high contrast photographic property.

The change in photographic properties upon hydrazine nucleation development is greatly dependent on the tone value of a silver halide emulsion. As the tone value on the foot portion is higher in the contrast, the change in photographic properties caused by fluctuation in the developer composition upon nucleation development can be smaller. Accordingly, also in the hydrazine nucleation development system, a silver halide emulsion having a high contrast photographic property is required.

As described in the foregoing, the silver halide emulsion for use in the photographic material for photo-mechanical process is demanded to exhibit high contrast. In order to meet these requirements, a technique for incorporating a heavy metal into a silver halide emulsion grain for use in the photographic material, a so-called metal doping technique, has been conventionally used. In the metal doping technique, a metal ion alone or a metal complex containing a ligand is taken (doped) into a silver halide grain. According to this technique, the silver halide grain is modified in the property and thereby the capability of an emulsion as a whole may be improved as intended.

*Research Disclosure*, No. 17643, Item IA, describes metal ions or metal complexes which can be incorporated during the grain formation, in relation to the metal doping technique.

Representative examples of the metal complex used at an initial stage of the metal doping technique are described in U.S. Pat. No. 2,448,060 and include metal complexes such as platinum, palladium, iridium, rhodium and ruthenium. When the above-described water-soluble metal complex is doped, it exhibits functions as an antifoggant or a stabilizer. In particular, a six coordination metal complex of palladium (IV) exhibits also a sensitization action. The complexes described in this publication each contains a halide such as chloride or bromide as a ligand.

With respect to the dopant containing a cyanide ion, JP-B-48-35373 (the term "JP-B" as used herein means an "examined Japanese patent publication") discloses, as a dopant containing a cyanide ion, yellow prussiate of potash and red prussiate of potash which are each a hexacyanometal complex of iron. The effect of the invention in this publication is limited only to the case where the complex contains an iron ion, irrespective of the kind of the ligand.

U.S. Pat. No. 3,790,390 discloses a silver halide emulsion containing a cyano complex of iron(II), iron(III) or cobalt (III) and also containing a spectral sensitizing dye.

U.S. Pat. No. 4,847,191 discloses a silver halide grain formed in the presence of a rhodium(III) complex having 3, 4, 5 or 6 cyano ligands. This patent publication reports the reduction in the high illumination failure with respect to a silver halide emulsion containing the above-described grain.

These publications disclose an effect obtained by taking a metal ion into a silver halide grain.

JP-A-2-20853 (the term "JP-A" as used herein means an "unexamined published Japanese patent publication") and JP-A-2-20854 each discloses a silver halide emulsion of which grain is formed in the presence of a rhenium, ruthenium, osmium or iridium complex having 4 or more cyano ligands. These publications describe increase in the aging stability of the sensitivity and the tone value and improvement in the low illumination failure.

In order to cut foots of the characteristic curve, it has been widely known to dope a metal complex containing a rhodium complex or an NO ligand into a silver halide grain. However, when the complex is doped to a silver halide grain, a tone value free of foots may be surely obtained but at the same time, the sensitivity is greatly reduced, the safelight immunity is lowered, or the stock storability is worsened.

SUMMARY OF THE INVENTION

An object of the present invention is to provide a high-sensitive and high-contrast silver halide photographic material for photomechanical process having excellent safelight immunity (safety) and superior storage stability.

Another object of the present invention is to provide a silver halide photographic material for photomechanical process which is stable against changes in the developer composition.

These and other objects of the present invention have been achieved by a silver halide photographic material comprising a support having provided thereon at least one silver halide emulsion layer, wherein the silver halide emulsion comprises silver halide grains having a silver chloride content of 50 mol % or more, and the silver halide grain contains a cyanochromium complex ion represented by the following formula (I) and at least one complex of a metal selected from rhodium, ruthenium, osmium, rhenium and iron:

$$[Cr(CN)_{6-n}L_n]^{m-} \quad (I)$$

wherein L represents $H_2O$ or OH; n represents 0 or 1; and m represents 3 or 4.

More preferably, in the above-described silver halide photographic material, at least one layer of the silver halide emulsion layer(s) and other hydrophilic colloid layer contains at least one hydrazine derivative.

DETAILED DESCRIPTION OF THE INVENTION

The present invention will be described below in detail.

In the present invention, a cyanochromium complex ion represented by formula (I) is doped into a silver halide grain. In formula (I), n is preferably 0, and m is preferably 3.

The cyanochromium complex ion is present in the form of an ion in an aqueous solution. Accordingly, a counter cation to the complex ion is not so much important in view of the technical point.

The counter cation may be selected from ions which are readily miscible with water and suitable for the precipitation operation of the silver halide emulsion. Examples of the counter cation include an alkali metal ion (e.g., sodium ion, potassium ion, rubidium ion, cesium ion, lithium ion), an ammonium ion and an alkylammonium ion. The alkylammonium ion is represented by the following formula (II):

$$[R_1R_2R_3R_4N]^+ \quad (II)$$

wherein $R_1$, $R_2$, $R_3$ and $R_4$ each bonds to an N atom and each represents a lower alkyl group having 6 or less carbon atoms. Examples of the lower alkyl group include a methyl group, an ethyl group, a propyl group, an iso-propyl group and an n-butyl group. $R_1$, $R_2$, $R_3$ and $R_4$ are preferably the same alkyl groups. Preferred examples of the alkylammonium ion include a tetramethylammonium ion, a tetraethylammonium ion, a tetrapropylammonium ion and a tetra(n-butyl)ammonium ion.

The cyanochromium complex ion may be dissolved in water or a mixed solvent of water with an appropriate organic solvent miscible with water (e.g., alcohols, ethers, glycols, ketones, esters, amides) before addition.

The cyanochromium complex ion is preferably incorporated into a silver halide grain by adding it directly to the reaction solution at the time of silver halide grain formation or by adding it to an aqueous silver halide solution or other solution used for forming silver halide grains and then conducting grain formation.

In doping a cyanochromium complex ion into a silver halide grain, it may be uniformly present inside a grain, or it may be doped at a higher concentration on the grain surface layer as disclosed in JP-A-4-208936, JP-A-2-125245 and JP-A-3-188437. Also, as disclosed in U.S. Pat. No. 5,252,451 and 5,256,530, the cyanochromium complex ion may be incorporated into the grain surface phase by using a silver halide fine grain doped with a cyanochromium complex ion and subjecting the silver halide grain to physical ripening. The above-described methods may also be used in combination.

The method for doping a cyanometal complex ion at a higher concentration on the grain surface is described in JP-A-2-125245, JP-A-3-188437 and JP-A-4-208936. The method using a silver halide fine grain doped with a cyanometal complex ion is described in U.S. Pat. Nos. 5,252,451 and 5,256,530. These methods may be applied to the cyanochromium complex ion of the present invention.

The doping amount of the cyanochromium complex ion is preferably from $1\times10^{-8}$ to $1\times10^{-2}$ mol, more preferably from $1\times10^{-7}$ to $1\times10^{-3}$ mol, per mol of silver halide.

The hydrogen ion concentration in the reaction solution is preferably a pH of 3 or more when the cyanochromium complex ion is added.

Specific examples of the cyanochromium metal ion include the following:

$$[Cr(CN)_6]^{3-} \quad (I\text{-}1)$$

$$[Cr(CN)_5(H_2O)]^{3-} \quad (I\text{-}2)$$

$$[Cr(CN)_5(OH)]^{4-} \quad (I\text{-}3)$$

The reason why the cyanochromium complex ion shows photographic effects different from other cyanometal complex may be presumed as follows.

When a silver halide grain absorbs light, a photoelectron and a positive hole are produced. The life of the excited photoelectron can be measured using a microwave photoconductivity. For example, in an emulsion doped with a hexacyanometal complex of Group VIII such as iron, ruthenium, cobalt and iridium (described in JP-A-6-51423), the life of photoelectron is prolonged and a temporary shallow electron trap is produced. When a shallow electron trap is produced, the electron contributes to formation of a latent image at a higher probability and the photographic sensitivity increases.

On the other hand, although it is the same cyanometal complex, the cyanochromium complex of the present invention exhibits an extremely short life when the life of an excited electron is measured. The cyanochromium complex is, therefore, considered to have a strong ability for trapping electrons. This is presumed to be a cause to reduce the photographic sensitivity and to provide high contrast.

As described in the foregoing, the cyanochromium complex clearly differs in the photographic effect from the hexacyanometal complex of Group VIII also in view of physical properties of the doped grain.

The silver halide grain for use in the silver halide photographic material of the present invention further contains at least one complex of a metal selected from rhodium, rhenium, ruthenium, osmium, iridium, cobalt and iron so as to achieve high contrast and low fogging. The complex of a metal such as rhodium, rhenium, ruthenium, osmium, iridium cobalt or iron may be used individually or in combination of two or more of the same or different metal complexes. The metal complex content is preferably from $1\times10^{-9}$ to $1\times10^{-2}$ mol/mol-Ag, more preferably from $1\times10^{-8}$ to $1\times10^{-4}$ mol/mol-Ag.

The metal complex may be appropriately added at the stage of during preparation of silver halide emulsion grains or before coating of the emulsion; however, it is preferably added at the time of formation of an emulsion to be taken into a silver halide grain and in this case, the compound may be added at any stage during preparation of silver halide grains, namely, before or after nucleation, growing, physical ripening or chemical ripening. The compound may be added by several installments, may be uniformly incorporated into the silver halide grain or as described in JP-A-63-29603, JP-A-2-306236, JP-A-3-167545, JP-A-4-76534, JP-A-6-110146, may be incorporated into the grain to have a distribution.

The metal complex may be dissolved in water or in an appropriate organic solvent miscible with water (e.g., alcohols, ethers, glycols, ketones, esters, amides) before addition. Examples of the method include a method of adding an aqueous solution having dissolved therein metal complex powder alone or in combination with NaCl or KCl to a water-soluble salt or a water-soluble halide solution during grain formation, a method of adding the metal complex solution as a third solution when a silver salt and a halide solution are simultaneously mixed and preparing silver halide grains according to a triple jet method of three solutions, a method of pouring an aqueous solution of the metal complex in a necessary amount into a reaction vessel during grain formation, and a method of adding and dissolving separate silver halide grains previously doped with rhodium at the time of preparation of silver halide. A method of adding an aqueous solution having dissolved therein the metal complex powder alone or in combination with NaCl or KCl to a water-soluble halide solution is particularly preferred.

In order to add the compound onto the grain surface, an aqueous solution of a metal complex in a necessary amount may be poured into a reaction vessel immediately after grain formation or during or after completion of the physical ripening.

The rhodium compound for use in the present invention may be a water-soluble rhodium compound. Examples thereof include a halogenorhodium(III) compound and a rhodium complex salt having a halogen, an amine or an oxalate as a ligand such as hexachlororhodium(III) complex salt, hexabromorhodium(III) complex salt, hexaaminerhodium(III) salt, trioxalaterhodium(III) complex salt and hexacyanorhodium(III) complex salt.

The addition amount of the rhodium compound varies depending upon the kind of ligand; however, it is preferably from $1\times10^{-8}$ to $5\times10^{-3}$ mol, more preferably from $5\times10^{-8}$ to $1\times10^{-4}$ mol, per mol of silver halide.

The rhenium, ruthenium or osmium is added in the form of a water-soluble complex salt described in JP-A-63-2042, JP-A-1-285941, JP-A-2-20852 and JP-A-2-20855. Particularly preferred examples of the complex salt of rhenium, ruthenium or osmium include six coordination complexes represented by the following formula:

$$[ML^1_6]^{n^1-}$$

wherein M represents Ru, Re or Os; $L^1$ represents a ligand; and $n^1$ represents 0, 1, 2, 3 or 4.

In this case, the counter ion is of no importance and an ammonium or alkali metal ion may be used.

Examples of preferred ligands include a halide ligand, a cyanide ligand, a cyan oxide ligand, a nitrosyl ligand and a thionitrosyl ligand. Specific examples of the complex for use in the present invention are set forth below, but the present invention is by no means limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{1-}$ | $[RuCl_5(NO)]^{2-}$ |
| $[RuBr_5(NS)]^{2-}$ | $[Ru(CN)_6]^{4-}$ | $[Ru(CO)_3Cl_3]^{2-}$ |
| $[Ru(CO)Cl_5]^{2-}$ | $[Ru(CO)Br_5]^{2-}$ | |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(CN)_6]^{4-}$ | $[Os(O)_2(CN)_4]^{4-}$ |

As the iridium complex for use in the present invention, various iridium complexes may be used, and examples thereof include a hexachloroiridium(III) complex salt, a hexachloroiridium(IV) complex salt, a hexabromoiridium (III) complex salt, a hexabromoiridium(IV) complex salt, a hexaiodoiridium(III) complex salt, a hexaiodoiridium(IV) complex salt, a hexaammineiridium(III) complex salt, a hexaammineiridium(IV) complex salt, a hexacyanoiridium (III) complex salt, a trioxalateiridium complex salt and a hexacyanoiridium complex salt.

As the cobalt or iron compound for use in the present invention, various compounds may be used; however, a hexacyanometal complex is particularly preferred. Specific examples thereof are set forth below.

$[Fe(CN)_6)^{4-}$ $[Fe(CN)_6]^{3-}$ $[Co(CN)_6]^{3-}$

The silver halide emulsion for use in a silver halide photographic material of the present invention is silver chloride, or silver chlorobromide, silver iodochlorobromide or silver iodochloride having a silver chloride content of 50 mol % or more. The silver iodide content is preferably 3 mol % or less, more preferably 0.5 mol % or less. The shape of the silver halide grain may be cubic, tetradecahedral, octahedral, amorphous or platy, but it is preferably cubic. The average grain size of silver halide is preferably from 0.1 to 0.7 μm, more preferably from 0.2 to 0.5 μm, and the grain size distribution is preferably narrow such that the coefficient of variation represented by {(standard deviation of grain size)/(average grain size)}×100 is preferably 15% or less, more preferably 10% or less.

The silver halide grain may comprise homogeneous or different layers between the inside and the surface layer.

The photographic emulsion for use in the present invention may be prepared according to the method described in P. Glafkides, *Chimie et Physique Photographique*, Paul Montel (1967), G. F. Duffin, *Photographic Emulsion Chemistry*, The Focal Press (1966) or V. L. Zelikman et al, *Making and Coating Photographic Emulsion*, The Focal Press (1964).

The reaction of a soluble silver salt with a soluble silver halide may be conducted by a single jet method, a double jet method or a combination thereof.

A method of forming grains in the presence of an excess of silver ions (so-called reverse mixing method) may also be used. As one mode of the double jet method, a method of keeping constant the pAg in the liquid phase where silver halide is formed, a so-called controlled double jet method, may also be used. Furthermore, it is preferred to form grains using a so-called silver halide solvent such as ammonia, thioether or tetra-substituted thiourea. The use of a tetra-substituted thiourea compound is more preferred as described in JP-A-53-82408 and JP-A-55-77737. Preferred examples of the thiourea compound includes tetramethylthiourea and 1,3-dimethyl-2-imidazolidinethione.

The controlled double jet method and the grain formation method using a silver halide solvent are a useful technique for forming a silver halide emulsion for use in the present invention because a silver halide emulsion comprising grains each having a regular crystal form and having a narrow grain size distribution can be easily prepared.

In order to render the grain size uniform, it is preferred to grow grains rapidly within the range not exceeding critical saturation by using a method of changing the addition rate of silver nitrate or alkali halide according to the grain growth rate as described in British Patent 1,535,016, JP-B-48-36890 and JP-B-52-16364 or a method of changing the concentration of the aqueous solution as described in British patent 4,242,445 and JP-A-55-158124.

To the silver halide grain of the present invention, a thiosulfonic acid compound represented by the following formula (II), (III) or (IV) is preferably added during the grain formation process. By incorporating the compound, a low-fogging emulsion can be obtained.

$$R—SO_2S—M \quad (II)$$

$$R—SO_2S—R^1 \quad (III)$$

$$R—SO_2S—L^2_{m2}—SSO_2—R^2 \quad (IV)$$

wherein R, $R^1$ and $R^2$, which may be the same or different, each represents an aliphatic group, an aromatic group or a heterocyclic group; M represents a cation; $L^2$ represents a divalent linking group; and $m^2$ represents 0 or 1.

The compound represented by formula (II), (III) or (IV) may be a polymer containing a divalent group derived from the structure represented by formula (II), (III) or (Iv) as a repeating unit.

Specific examples of the compounds represented by formulae (II) to (IV) are set forth below.

$CH_3SO_2SNa$ (2-1)
$C_2H_5SO_2SNa$ (2-2)
$C_3H_7SO_2SK$ (2-3)
$C_4H_9SO_2SLi$ (2-4)
$C_6H_{13}SO_2SNa$ (2-5)
$C_8H_{17}SO_2SNa$ (2-6)

$CH_3(CH_2)_3CH(C_2H_5)CH_2SO_2S.NH_4$ (2-7)

$C_{10}H_{21}SO_2SNa$ (2-8)
$C_{12}H_{25}SO_2SNa$ (2-9)
$C_{16}H_{33}SO_2SNa$ (2-10)

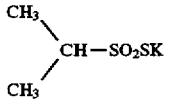
(2-11)

$t\text{-}C_4H_9SO_2SNa$ (2-12)
$CH_3OCH_2CH_2SO_2S.Na$ (2-13)

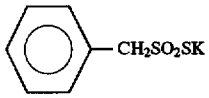
(2-14)

$CH_2=CHCH_2SO_2SNa$ (2-15)

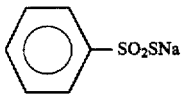
(2-16)

-continued

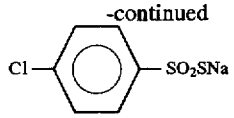
(2-17)

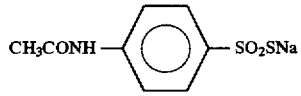
(2-18)

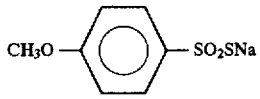
(2-19)

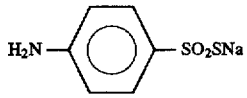
(2-20)

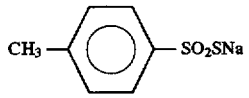
(2-21)

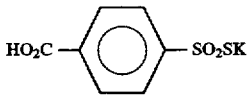
(2-22)

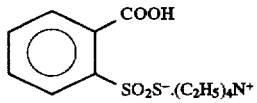
(2-23)

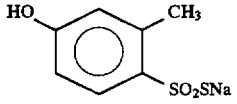
(2-24)

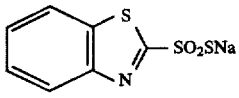
(2-25)

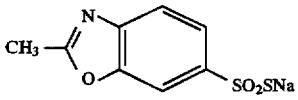
(2-26)

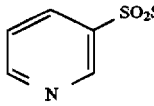
(2-27)

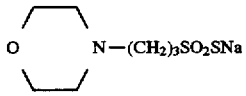
(2-28)

$C_2H_5SO_2S—CH_3$ (3-1)
$C_8H_{17}SO_2SCH_2CH_3$ (3-2)

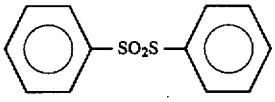
(3-3)

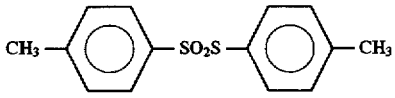
(3-4)

$C_2H_5SO_2SCH_2CH_2CN$ (3-5)

-continued (3-6)

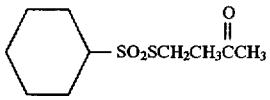

(3-7)

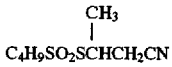

(3-8)

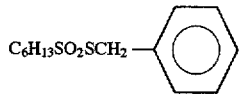

(3-9)

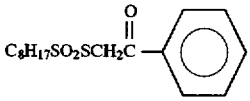

(3-10)

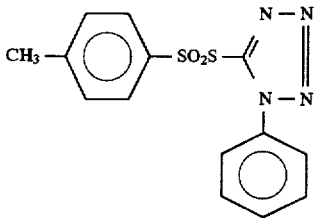

(3-11)

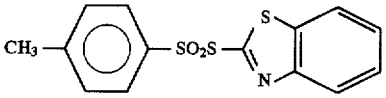

(3-12)

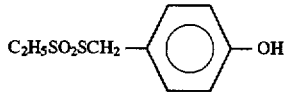

(3-13)

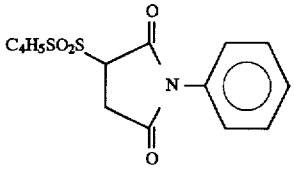

(3-14)

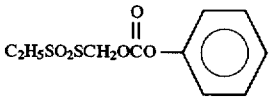

(3-15)

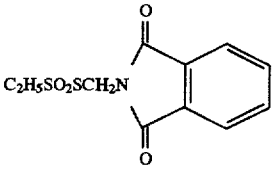

(3-16)

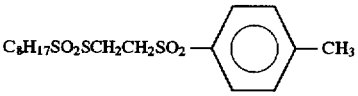

(3-17)

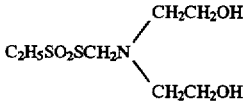

(3-18)

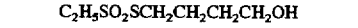

-continued (3-19)

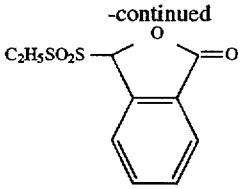

(3-20)

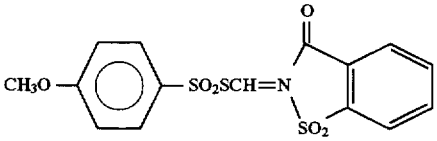

(4-1)

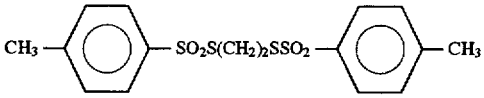

(4-2)

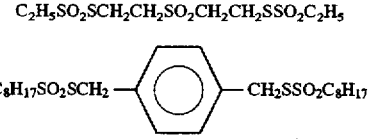

(4-3)

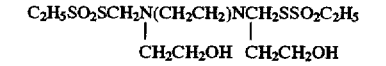

(4-4)

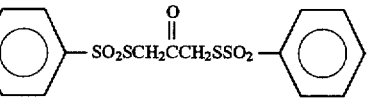

(4-5)

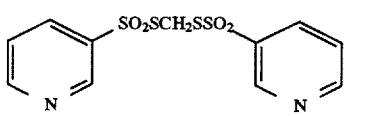

(4-6)

(4-7)

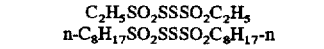

(4-8)

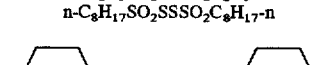

(4-9)

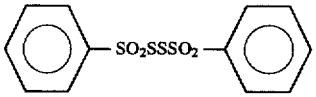

The addition amount of thiosulfonic acid compounds is preferably from $10^{-6}$ to $10^{-2}$ mol/mol-Ag, more preferably from $5\times10^{-6}$ to $10^{-3}$ mol/mol-Ag.

Furthermore, a photographic material for illuminated room having excellent handleability in an illuminated room (safelight immunity), high sensitivity in practical use and superior storage stability, can be obtained by a silver halide photographic material comprising a support having provided thereon at least one silver halide emulsion layer, wherein the silver halide emulsion layer contains a cyanochromium complex ion represented by formula (I) in an amount of $1\times10^{-7}$ mol or more, per mol of silver halide, silver halide grains obtained by conducting silver halide grain formation at a pH of 4 or more and having a silver chloride content of 95 mol % or more, and at least one compound represented by formula (II), (III) or (IV).

The silver halide emulsion of the present invention may be subjected to chemical sensitization. Known methods such as sulfur sensitization, selenium sensitization, tellurium sensitization and noble metal sensitization may be used individually or in combination. In using these sensitization methods in combination, for example, a combination of sulfur sensitization and gold sensitization, a combination of sulfur sensitization, selenium sensitization and gold sensitization, and a combination of sulfur sensitization, tellurium sensitization and gold sensitization are preferred.

The sulfur sensitization for use in the present invention is conducted usually by adding a sulfur sensitizer and stirring the emulsion at a high temperature of 40° C. or higher for a fixed time. The sulfur sensitizer may be a known compound and in addition to the sulfur compound contained in gelatin, various sulfur compounds such as thiosulfates, thioureas, thiazoles and rhodanines may be used. Preferred sulfur compounds are thiosulfates and thiourea compounds. The addition amount of the sulfur sensitizer varies according to various conditions such as the pH and the temperature at chemical ripening and the size of a silver halide grain, but it is preferably from $10^{-7}$ to $10^{-2}$ mol, more preferably from $10^{-5}$ to $10^{-3}$ mol, per mol of silver halide.

The selenium sensitizer for use in the present invention may be a known selenium compound. More specifically, the selenium sensitization is usually conducted by adding an unstable and/or non-unstablee selenium compound and stirring the emulsion at a high temperature, preferably at 40° C. or higher, for a fixed time. The unstable type selenium compound includes the compounds described in JP-B-44-15748, JP-B-43-13489, JP-A-4-25832, JP-A-4-109240, and JP-A-4-324855. In particular, the compounds represented by formulae (VIII) and (IX) of JP-A-4-324855 are preferred.

The tellurium sensitizer for use in the present invention is a compound which forms silver telluride assumed to serve as a sensitization nucleus on the surface or inside of a silver halide grain. The silver telluride formation rate in a silver halide emulsion may be examined according to the method described in JP-A-5-313284.

More specifically, the compounds described in U.S. Pat. Nos. 1,623,499, 3,320,069 and 3,772,031, British Patents 235,211, 1,121,496, 1,295,462 and 1,396,696, Canadian Patent 800,958, JP-A-4-204640, JP-A-4-271341, JP-A-4-333043, and JP-A-5-303157, *J. Chem. Soc. Chem. Commun.*, 635 (1980), ibid., 1102 (1979), ibid., 645 (1979), *J. Chem. Soc. Perkin. Trans.*, 1, 2191 (1980), S. Patai (compiler), *The Chemistry of Organic Selenium and Tellurium Compounds*, Vol. 1 (1986), ibid., Vol. 2 (1987) may be used. In particular, the compounds represented by formulae (II), (III) and (IV) of JP-A-5-313284 are preferred.

The addition amount of the selenium or tellurium sensitizer for use in the present invention varies depending upon the silver halide grain used or chemical ripening conditions, but it is generally from $10^{-8}$ to $10^{-2}$ mol, preferably from $10^{-7}$ to $10^{-3}$ mol, per mol of silver halide. The conditions for chemical sensitization are not particularly restricted in the present invention, but the pH is from 5 to 8, the pAg is from 6 to 11, preferably from 7 to 10, and the temperature is from 40° to 95° C., preferably from 45° to 85° C.

As the noble metal sensitizer for use in the present invention, gold, platinum or palladium may be used, but the gold sensitization is particularly preferred. Specific examples of the gold sensitizer for use in the present invention include chloroauric acid, potassium chloroaurate, potassium aurithiocyanate and gold sulfide, and the gold sensitizer may be used in an amount of approximately from $10^{-7}$ to $10^{-2}$ mol per mol of silver halide.

In the silver halide emulsion for use in the present invention, a cadmium salt, a sulfite, a lead salt or a thallium salt may be present together during the formation or physical ripening of silver halide grains.

In the present invention, a reduction sensitizer may be used. As the reduction sensitizer, a stannous salt, amines, formamidinesulfinic acid or a silane compound may be used.

To the silver halide emulsion of the present invention, a thiosulfonic acid compound may be added by the method described in European Patent 293917.

In the photographic material for use in the present invention, one kind of silver halide emulsion may be used or two kinds of silver halide emulsions (for example, those different in the average grain size, different in the halogen composition, different in the crystal habit or different in the chemical sensitization conditions) may be used in combination.

The silver halide photographic material of the present invention preferably contains in the silver halide emulsion layer or other hydrophilic colloid layer at least one hydrazine derivative represented by the following formula (H):

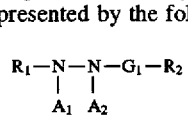

$$R_1-\underset{\underset{A_1}{|}}{N}-\underset{\underset{A_2}{|}}{N}-G_1-R_2 \qquad \text{(H)}$$

wherein $R_1$ represents an aliphatic group or an aromatic group; $R_2$ represents a hydrogen atom, an alkyl group, an aryl group, an unsaturated heterocyclic group, an alkoxy group, an aryloxy group, an amino group or a hydrazino group; $G_1$ represents

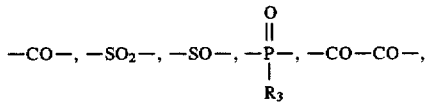

$$-CO-,\ -SO_2-,\ -SO-,\ -\overset{\overset{O}{\|}}{\underset{\underset{R_3}{|}}{P}}-,\ -CO-CO-,$$

a thiocarbonyl group or an iminomethylene group; $A_1$ and $A_2$ both represent a hydrogen atom, or one represents a hydrogen atom and the other represents a substituted or unsubstituted alkylsulfonyl group, a substituted or unsubstituted arylsulfonyl group, or a substituted or unsubstituted acyl group, and $R_3$ is selected from the same groups defined for $R_2$ and may be different from $R_2$.

In formula (H), the aliphatic group represented by $R_1$ is preferably an aliphatic group having from 1 to 30 carbon atoms, more preferably a linear, branched or cyclic alkyl group having from 1 to 20 carbon atoms. The branched alkyl group may be cyclized to form a saturated heterocyclic ring containing therein one or more hetero atoms. The alkyl group may have a substituent.

In formula (H), the aromatic group represented by $R_1$ is a monocyclic or bicyclic aryl group or an unsaturated heterocyclic group. The unsaturated heterocyclic group may be ring-condensed with a monocyclic or bicyclic aryl group to form a heteroaryl group. Examples of the ring formed by $R_1$ include a benzene ring, a naphthalene ring, a pyridine ring, a pyrimidine ring, an imidazole ring, a pyrazole ring, a quinoline ring, an isoquinoline ring, a benzimidazole ring, a thiazole ring and a benzothiazole ring. In particular, those containing a benzene ring are preferred. $R_1$ is particularly preferably an aryl group.

The aliphatic group or aromatic group represented by $R_1$ may be substituted with one or more substituents. Specific examples of the substituent include an alkyl group, an alkenyl group, an alkynyl group, an aryl group, a group containing a heterocyclic ring, a pyridinium group, a hydroxyl group, an alkoxy group, an aryloxy group, an acyloxy group, an alkylsulfonyloxy group, an arylsulfonyloxy group, an amino group, a carbonamido group, a sulfonamido group, a ureido group, a thioureido group, a semicarbazido group, a thiosemicarbazido group, a urethane group, a group having a hydrazide structure, a group having a quaternary ammonium structure, an alkylthio group, an arylthio group, an alkylsulfonyl group, an arylsulfonyl group, an alkylsulfinyl group, an arylsulfinyl group, a carboxyl group, a sulfo group, an acyl group, an alkoxycarbonyl group, an aryloxycarbonyl group, a carbamoyl group, a sulfamoyl group, a halogen atom, a cyano group, a phosphoric acid amido group, a diacylamino group, an imido group, a group having an acylurea structure, a group containing a selenium atom or a tellurium atom, and a group having a tertiary sulfonium structure or a quaternary sulfonium structure. Preferred examples of the substituents include a linear, branched or cyclic alkyl group (preferably having from 1 to 20 carbon atoms), an aralkyl group (preferably monocyclic or bicyclic with the alkyl moiety having from 1 to 3 carbon atoms), an alkoxy group (preferably having from 1 to 20 carbon atoms), a substituted amino group (preferably an amino group substituted with an alkyl group having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms) and a phosphoric acid amido group (preferably having from 1 to 30 carbon atoms).

In formula (H), the alkyl group represented by $R_2$ is an alkyl group having from 1 to 4 carbon atoms, and the aryl group represented by $R_2$ is preferably a monocyclic or bicyclic aryl group, for example, one containing a benzene ring.

The unsaturated heterocyclic group represented by $R_2$ is a 5- or 6-membered ring compound containing at least one of a nitrogen atom, an oxygen atom and a sulfur atom. Examples thereof include an imidazolyl group, a pyrazolyl group, a triazolyl group, a tetrazolyl group, a pyridyl group, a pyridinium group, a quinolinium group and a quinolinyl group. A pyridyl group or a pyridinium group are particularly preferred.

The alkoxy group represented by $R_2$ is preferably an alkoxy group having from 1 to 8 carbon atoms, the aryloxy group represented by $R_2$ is preferably a monocyclic aryloxy group, and the amino group represented by $R_2$ is preferably an unsubstituted amino group, an alkylamino group having from 1 to 10 carbon atoms, or an arylamino group having from 6 to 10 carbon atoms.

$R_2$ may be substituted with one or more substituents and preferred substituents include those exemplified for the substituents of $R_1$.

When $G_1$ is —CO—, $R_2$ is preferably a hydrogen atom, an alkyl group (e.g., methyl, monofluoromethyl, difluoromethyl, trifluoromethyl, 3-hydroxypropyl, 3-methanesulfonamidopropyl, phenylsulfonylmethyl, pyridinium methyl), an aralkyl group (e.g., o-hydroxybenzyl), or an aryl group (e.g., phenyl, 3,5-dichlorophenyl, o-methanesulfonamidophenyl, 4-methanesulfonylphenyl, 2-hydroxymethylphenyl), more preferably a hydrogen atom, a monofluoromethyl group, a difluoromethyl group or a trifluoromethyl group.

When $G_1$ is —$SO_2$—, $R_2$ is preferably an alkyl group (e.g., methyl), an aralkyl group (e.g., o-hydroxybenzyl), an aryl group (e.g., phenyl) or a substituted amino group (e.g., dimethylamino).

When $G_1$ is —COCO—, $R_2$ is preferably an alkoxy group, an aryloxy group or an amino group.

In formula (H), $G_1$ is preferably —CO—or —COCO—, and most preferably —CO—.

$R_2$ may be a group which induces a cyclization reaction by cleaving the —$G_1$—$R_2$ moiety from the remaining molecule to form a cyclic structure containing atoms in the —$G_1$—$R_2$ moiety. Examples thereof include those described, for example, in JP-A-63-29751.

$A_1$ and $A_2$ are each a hydrogen atom, an alkylsulfonyl or arylsulfonyl group having from 1 to 20 carbon atoms (preferably, a phenylsulfonyl group or a phenylsulfonyl group substituted so that the sum of Hammett's substituent constants becomes −0.5 or more) or an acyl group having from 1 to 20 carbon atoms (preferably a benzoyl group, a benzoyl group substituted so that the sum of Hammett's substituent constants becomes −0.5 or more, or a linear, branched or cyclic, unsubstituted or substituted aliphatic acyl group (examples of the substituent includes a halogen atom, an ether group, a sulfonamido group, a carbonamido group, a hydroxyl group, a carboxyl group, a sulfone group) ).

$A_1$ and $A_2$ are most preferably a hydrogen atom.

In formula (H), $R_1$ and $R_2$ each may be further substituted with a substituent and preferred examples of the substituent include those exemplified for the substituent of $R_1$. Furthermore, the substituent may be substituted in multiple ways such that the substituent, the substituent of the substituent, the substituent of the substituent of the substituent . . . is substituted and examples of the substituents also include those exemplified for the substituent of $R_1$.

In formula (H), $R_1$ or $R_2$ may be one having integrated thereinto a ballast group or a polymer commonly used in the immobile photographic additives such as a coupler. The ballast group is a group having 8 or more carbon atoms and relatively inactive to the photographic properties and examples thereof include an alkyl group, an aralkyl group, an alkoxy group, a phenyl group, an alkylphenyl group, a phenoxy group and an alkylphenoxy group. Examples of the polymer include those described, for example, in JP-A-1-100530.

In formula (H), $R_1$ or $R_2$ may be one having integrated thereinto a group capable of intensifying the adsorption onto the silver halide grain surface. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a heterocyclic thioamido group, a mercapto heterocyclic group and a triazole group.

The hydrazine derivative preferred in the present invention is a hydrazine derivative where $R_1$ is a phenyl group having a ballast group, a group which accelerates adsorption on the silver halide grain surface, a group having a quaternary ammonium structure or a phenyl group having an alkylthio group through a sulfonamido group, an acylamino group or a ureido group; G is —CO—; and $R_2$ is a hydrogen atom, a substituted alkyl group or a substituted aryl group (the substituent is preferably an electron-withdrawing group or a hydroxymethyl group at the 2-position). With respect to the selected groups for each of $R_1$ and $R_2$, any combination may be freely used and preferred.

In the present invention, a hydrazine derivative having, in the vicinity of the hydrazine group, an anionic group or a nonionic group which forms an intermolecular hydrogen bond with the hydrogen atom of the hydrazine, is preferably used.

Specific examples of the anionic group include a carboxylic acid group, a sulfonic acid group, a sulfinic acid group, a phosphoric acid group, a phosphonic acid group, and salts thereof. The nonionic group which forms an intermolecular hydrogen bond with hydrogen of hydrazine is a group which forms a 5-, 6- or 7-membered ring by a hydrogen bond of a lone electron pair with the hydrogen of hydrazine and has at least one of an oxygen atom, a nitrogen atom, a sulfur atom and a phosphorus atom. Examples of the nonionic group include an alkoxy group, an amino group, an alkylthio group, a carbonyl group, a carbamoyl group, an alkoxycarbonyl group, a urethane group, a ureido group, an acyloxy group and an acylamino group.

Among these, an anionic group is preferred, and carboxylic acid and salts thereof are most preferred.

The nucleating agent for use in the present invention is preferably a compound represented by the following formula (H-1), (H-2) or (H-3):

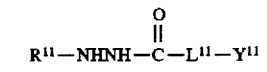

(H-1)

wherein $R^{11}$ represents an alkyl group, an aryl group or a heterocyclic group; $L^{11}$ represents a divalent linking group having an electron withdrawing group; and $Y^{11}$ represents an anionic group or a nonionic group which forms an intermolecular hydrogen bond with the hydrogen atom of hydrazine;

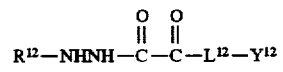

(H-2)

wherein $R^{12}$ represents an alkyl group, an aryl group or a heterocyclic group; $L^{12}$ represents a divalent linking group; and $Y^{12}$ represents an anionic group or a nonionic group which forms an intermolecular hydrogen bond with the hydrogen atom of hydrazine; or

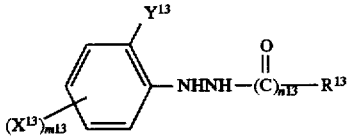

(H-3)

wherein $X^{13}$ represents a group capable of bonding to the benzene ring; $R^{13}$ represents an alkyl group, an alkenyl group, an alkynyl group, an aryl group, a heterocyclic group, an alkoxy group or an amino group; $Y^{13}$ represents an anionic group or a nonionic group which forms an intermolecular hydrogen bond with the hydrogen atom of hydrazine; $m^{13}$ represents an integer of from 0 to 4; and $n^{13}$ represents 1 or 2, and when $n^{13}$ is 1, $R^{13}$ has an electron withdrawing group.

Formulae (H-1) to (H-3) are described below in greater detail.

The alkyl group represented by $R^{11}$ or $R^{12}$ includes a linear, branched or cyclic alkyl group having from 1 to 16, preferably from 1 to 12, carbon atoms. Examples thereof include methyl, ethyl, propyl, isopropyl, t-butyl, allyl, propargyl, 2-butenyl, 2-hydroxyethyl, benzyl, benzhydryl, trityl, 4-methylbenzyl, 2-methoxyethyl, cyclopentyl and 2-acetamidoethyl.

The aryl group represented by $R^{11}$ or $R^{12}$ includes an aryl group having from 6 to 24, preferably from 6 to 12, carbon atoms. Examples thereof include phenyl, naphthyl, p-alkoxyphenyl, p-sulfonamidophenyl, p-ureidophenyl and p-amidophenyl. The heterocyclic group represented by $R^{11}$ or $R^{12}$ includes a 5- or 6-membered saturated or unsaturated heterocyclic ring having from 1 to 5 carbon atoms and containing one or more of an oxygen atom, a nitrogen atom and a sulfur atom. The number of the hetero atoms constituting the ring and the kind of element may be single or in plurality. Examples of the heterocyclic ring include 2-furyl, 2-thienyl and 4-pyridyl.

$R^{11}$ and $R^{12}$ are each preferably an aryl group, an aromatic heterocyclic group or an aryl-substituted methyl group, more preferably an aryl group (e.g., phenyl, naphthyl). $R^{11}$ and $R^{12}$ may be substituted with one or more substituents and examples of the substituents include an alkyl group, an aralkyl group, an alkoxy group, an alkyl- or aryl-substituted amino group, an amido group, a sulfonamido group, a ureido group, a urethane group, an aryloxy group, a sulfamoyl group, a carbamoyl group, an aryl group, an alkylthio group, an arylthio group, a sulfonyl group, a sulfinyl group, a hydroxyl group, a halogen atom, a cyano group, a sulfo group, a carboxyl group and a phosphoric acid amido group. These groups may further be substituted. Among these, a sulfonamido group, a ureido group, an amido group, an alkoxy group and a urethane group are preferred, and a sulfonamido group and a ureido group are more preferred. These groups may be combined with each other to form a ring, if possible.

The alkyl group, the aryl group and the heterocyclic group represented by $R^{13}$ include those described above for $R^{11}$. The alkenyl group represented by $R^{13}$ includes an alkenyl group having from 2 to 18, preferably from 2 to 10, carbon atoms. Examples thereof include vinyl and 2-styryl. The alkynyl group represented by $R^{13}$ includes an alkynyl group having from 2 to 18, preferably from 2 to 10, carbon atoms. Examples thereof include ethynyl and phenylethynyl. The alkoxy group represented by $R^{13}$ includes a linear, branched or cyclic alkoxy group having from 1 to 16, preferably from 1 to 10, carbon atoms. Examples thereof include methoxy, isopropoxy and benzyloxy. The amino group represented by $R^{13}$ includes an amino group having from 0 to 16, preferably from 1 to 10, carbon atoms. Examples thereof include ethylamino, benzylamino and phenylamino.

When $n^{13}$ is 1, $R^{13}$ is preferably an alkyl group, an alkenyl group or an alkynyl group. When $n^{13}$ is 2, $R^{13}$ is preferably an amino group or an alkoxy group.

The electron withdrawing group contained in $R^{13}$ includes an electron withdrawing group having a Hammett's $\sigma_m$ value of 0.2 or more, preferably 0.3 or more. Examples thereof include a halogen atom (e.g., fluorine, chlorine, bromine), a cyano group, a sulfonyl group (e.g., methanesulfonyl, benzene-sulfonyl), a sulfinyl group (e.g., methanesulfinyl), an acyl group (e.g., acetyl, benzoyl), an oxycarbonyl group (e.g., methoxycarbonyl), a carbamoyl group (e.g., N-methylcarbamoyl), a sulfamoyl group (e.g., methylsulfamoyl), a halogen-substituted alkyl group (e.g., trifluoromethyl), a heterocyclic group (e.g., 2-benzoxazolyl, pyrrolo) and a quaternary onium group (e.g., triphenylphosphonium, trialkylammonium, pyridinium). Examples of $R^{13}$ having an electron withdrawing group include trifluoromethyl, difluoromethyl, pentafluoroethyl, cyanomethyl, methanesulfonylmethyl, acetylethyl, trifluoromethylethynyl and ethoxycarbonylmethyl.

$L^{11}$ and $L^{12}$ each represents a divalent linking group and includes an alkylene group, an alkenylene group, an alkynylene group, an arylene group, a divalent heterocyclic group and a group formed by linking these groups through an individual group or a combination of —O—, —S—, —NH—, —CO— and —$SO_2$—. $L^{11}$ and $L^{12}$ may be substituted with a group described above as the substituents of $R^{11}$. Examples of the alkylene group include methylene, ethylene, trimethylene, pentamethylene, octamethylene, propylene, 2-buten-1,4-yl, 2-butyn-1,4-yl and p-xylylene. Examples of the alkenylene group include vinylene. Examples of the alkynylene group include ethynylene. Examples of the arylene group include phenylene. Examples of the divalent heterocyclic group include furan-1,4-diyl. $L^{11}$ is preferably an alkylene group, an alkenylene group, an alkynylene group or an arylene group, more preferably an alkylene group, most preferably an alkylene group having a chain length of from 2 to 3 carbon atoms. $L^{12}$ is preferably an alkylene group, an arylene group, —NH-alkylene-, —O-alkylene- or —NH-arylene-, more preferably —NH-alkylene- or —O-alkylene-.

The electron withdrawing group contained in $L^{11}$ includes those described above as the electron withdrawing group contained $R^3$. Examples of $L^{11}$ include tetrafluoroethylene, fluoromethylene, hexafluorotrimethylene, perfluorophenylene, difluorovinylene, cyanomethylene and methanesulfonylethylene.

$Y^{11}$, $Y^{12}$ and $Y^{13}$ each represents an anionic group or a nonionic group which forms a 5-, 6- or 7-membered ring by an intermolecular hydrogen bond of a lone electron pair with the hydrogen atom of hydrazine. Examples of the anionic group include a carboxylic acid group, a sulfonic acid group, a sulfinic acid group, a phosphoric acid group, a phosphonic acid group and salts thereof. Examples of the salts include an alkali metal ion (e.g., sodium, potassium), an alkali earth metal ion (e.g., calcium, magnesium), an ammonium (e.g., ammonium, triethylammonium, tetrabutylammonium, pyridinium) and a phosphonium (e.g., tetraphenylphosphonium). The nonionic group is a group having at least one of an oxygen atom, a nitrogen atom, a sulfur atom and a phosphorus atom. Examples thereof include an alkoxy group, an amino group, an alkylthio group, a carbonyl group, a carbamoyl group, an alkoxycarbonyl group, a urethane group, a ureido group, an acyloxy group and an acylamino group. $Y^{11}$, $Y^{12}$ and $Y^{13}$ are each preferably an anionic group, more preferably a carboxylic acid group or salts thereof.

Specific examples and preferred examples of the group capable of bonding to the benzene ring represented by $X^{13}$ include those described above as the substituent which $R^{11}$ in formula (H-1) has. When $m^{13}$ is 2 or greater, the plurality of $X^{13}$'s may be the same or different.

$R^{11}$, $R^{12}$, $R^{13}$ and $X^{13}$ may have a non-diffusible group used in a photographic coupler or may have an adsorption accelerating group onto silver halide. The non-diffusible group includes a non-diffusible group having from 8 to 30, preferably from 12 to 25, carbon atoms. Preferred examples of the adsorption accelerating group onto silver halide include thioamidos (e.g., thiourethane, thioureido, thioamido), mercaptos (e.g., heterocyclic mercapto such as 5-mercaptotetrazole, 3-mercapto-1,2,4-triazole, 2-mercapto-1,3,4-thiadiazole and 2-mercapto-1,3,4-oxazole, alkylmercapto, arylmercapto) and 5- or 6-membered nitrogen-containing heterocyclic rings capable of forming imino silver (e.g., benzotriazole). The group having an adsorption accelerating group onto silver halide includes those having such a structure that an adsorption group is protected and the protective group is removed upon development processing to increase the adsorptivity onto silver halide.

In formulae (H-1) to (H-3), the radicals resulting from removal of respective hydrogen atoms of two compounds may be combined with each other to form a bis form.

Among formulae (H-1) to (H-3), formulae (H-1) and (H-2) are preferred, and formula (H-1) is more preferred. The compound represented by formula (H-1), (H-2) or (H-3) is more preferably a compound represented by formula (H-4), (H-5) or (H-6), most preferably a compound represented by formula (H-4):

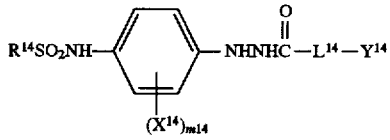

(H-4)

wherein $R^{14}$, $X^{14}$ and $m^{14}$ have the same meaning as $R^{13}$, $X^{13}$ and $m^{13}$ in formula (H-3), respectively; and $L^{14}$ and $Y^{14}$ have the same meaning as $L^{11}$ and $Y^{11}$ in formula (H-1), respectively;

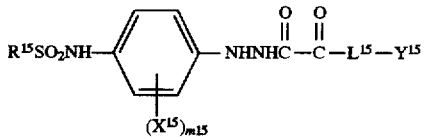

(H-5)

wherein $R^{15}$, $X^{15}$ and $m^{15}$ have the same meaning as $R^{13}$, $X^{13}$ and $m^{13}$ in formula (H-3), respectively; and $L^{15}$ and $Y^{15}$ have the same meaning as $L^{12}$ and $Y^{12}$ in formula (H-2), respectively;

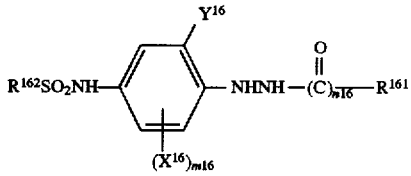

(H-6)

wherein $R^{161}$, $R^{162}$, $X^{16}$, $m^{16}$, $n^{16}$ and $Y^{16}$ have the same meaning as $R^{13}$, $R^{13}$, $X^{13}$, $m^{13}$, $n^{13}$ and $Y^{13}$ in formula (H-3), respectively.

Specific examples of the hydrazine derivative for use in the present invention are set forth below, but the present invention is by no means limited to these.

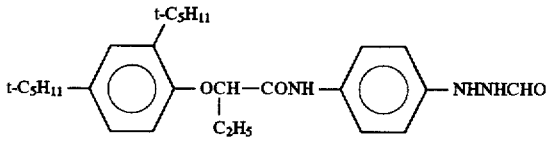

I-1

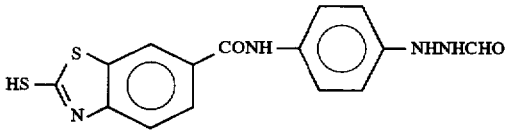

I-2

-continued
I-3
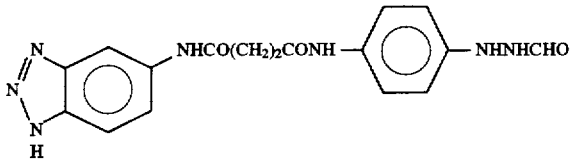
I-4
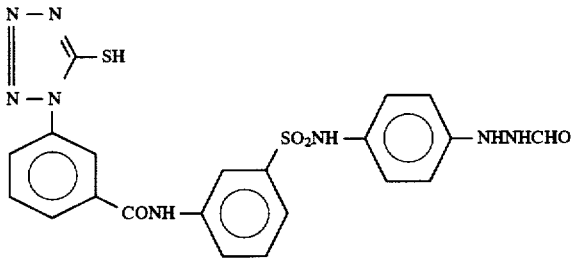
I-5
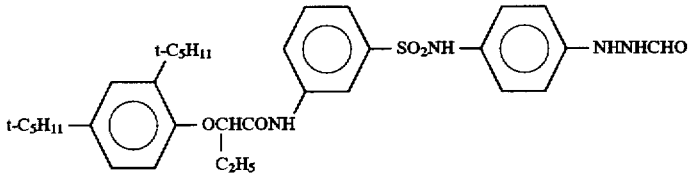
I-6
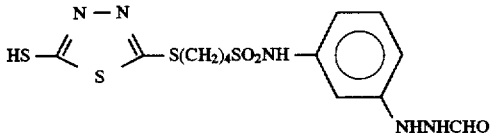
I-7
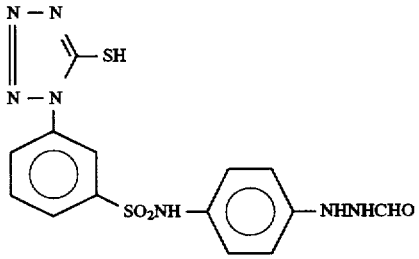
I-8
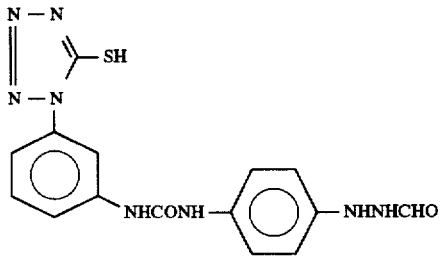
I-9
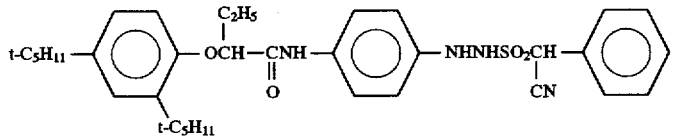
I-10
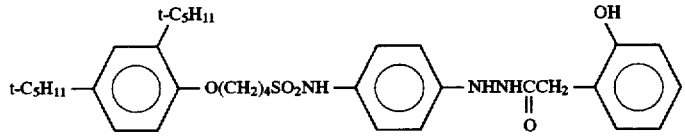

-continued
I-11
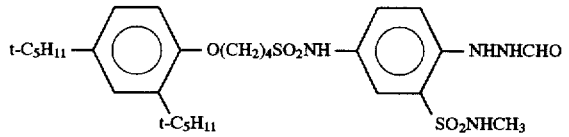
I-12
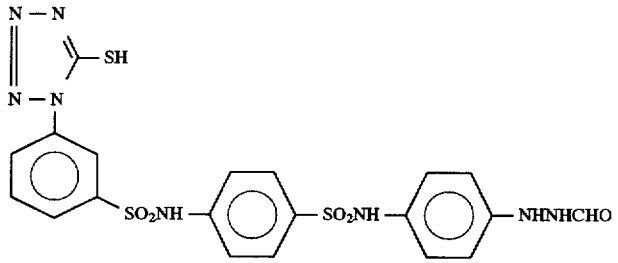
I-13
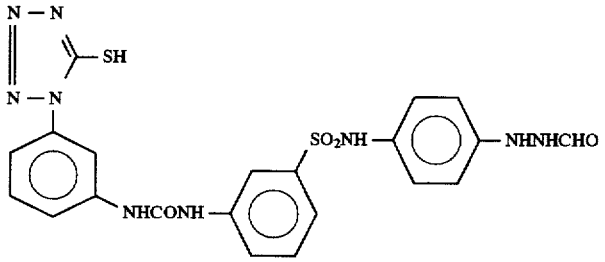
I-14
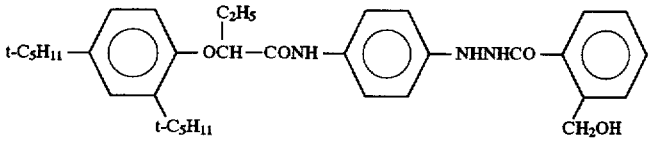
I-15
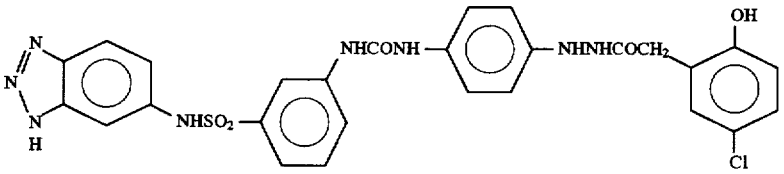
I-16
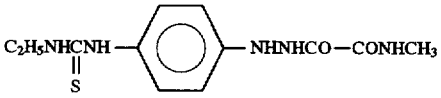
I-17
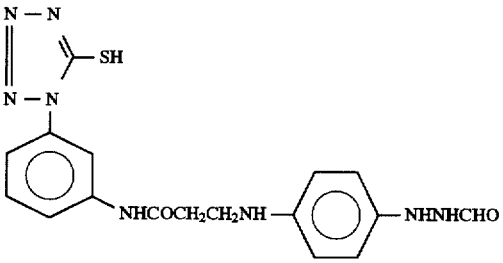
I-18
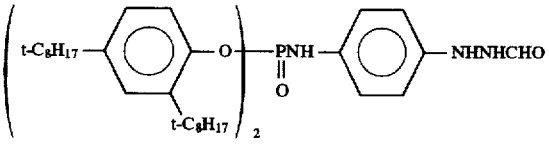

-continued
I-19
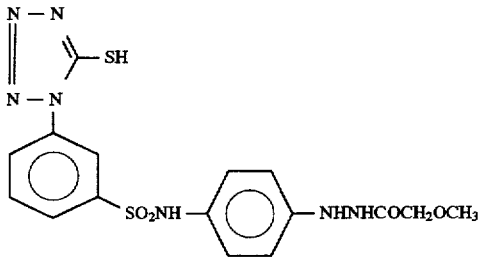
I-20
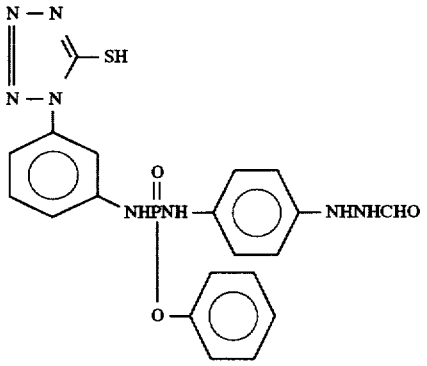
I-21
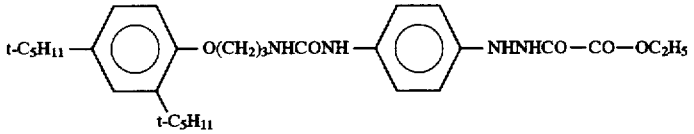
I-22
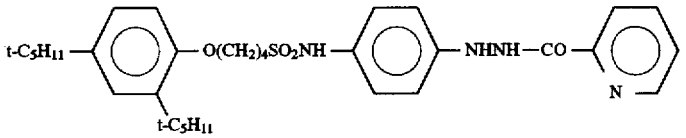
I-23
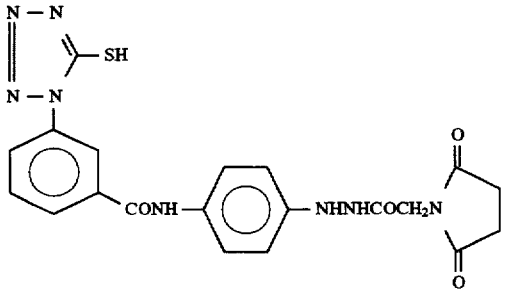
I-24
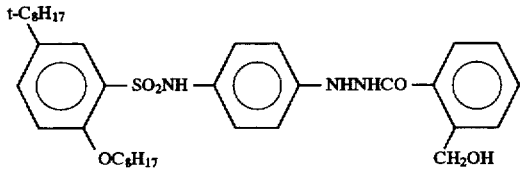
I-25
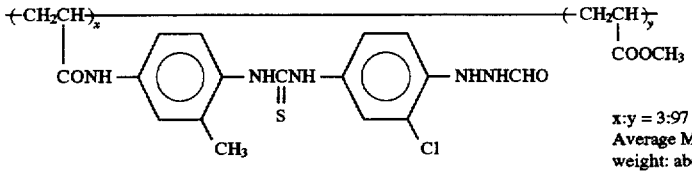
x:y = 3:97
Average Molecular weight: about 100,000

-continued
I-26
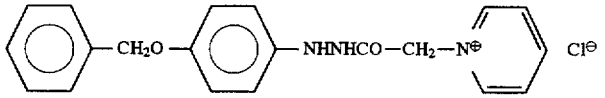
I-27
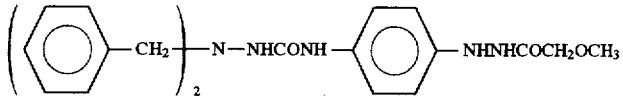
I-28
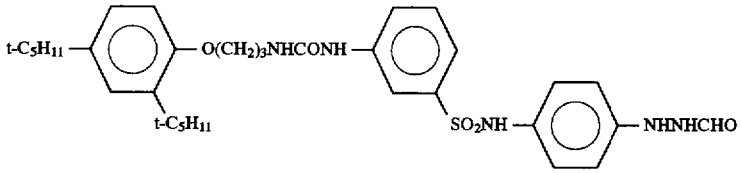
I-29
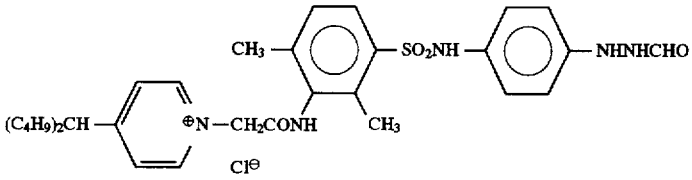
I-30
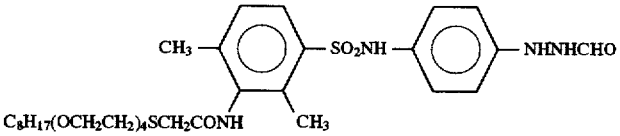
I-31
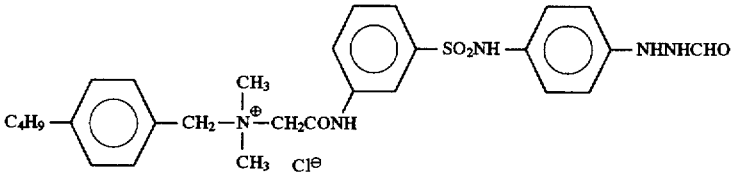
I-32
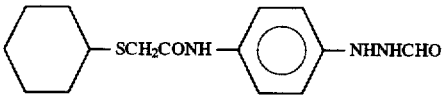
I-33
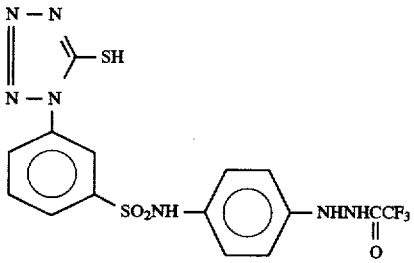
I-34
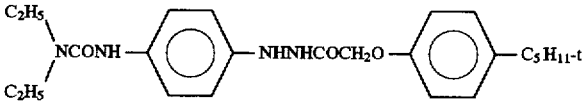
I-35
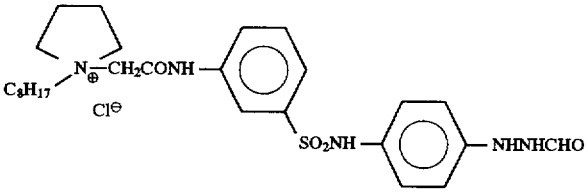

-continued
I-36
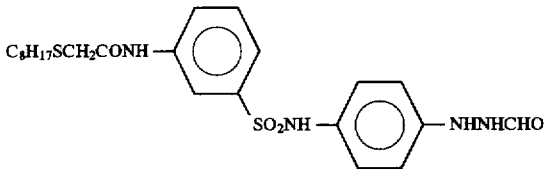
I-37
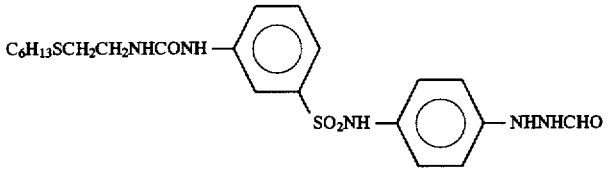
I-38
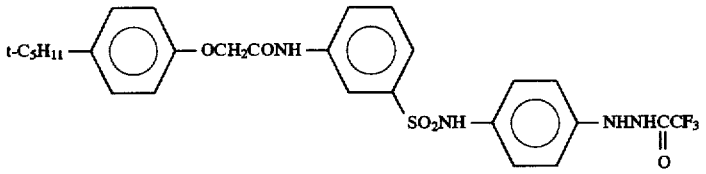
I-39
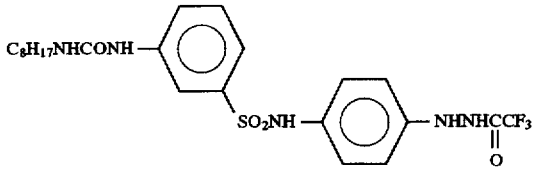
I-40
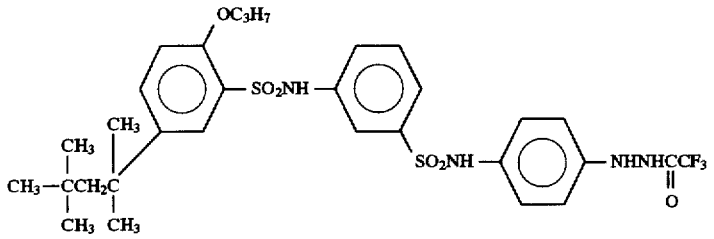
I-41
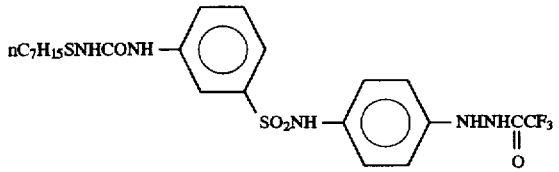
I-42
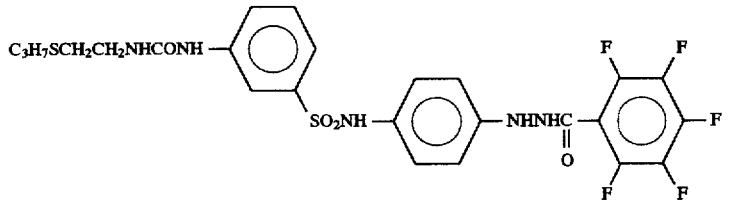
I-43
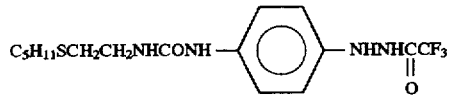

-continued
I-44
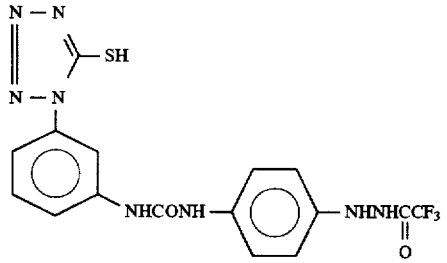
I-45
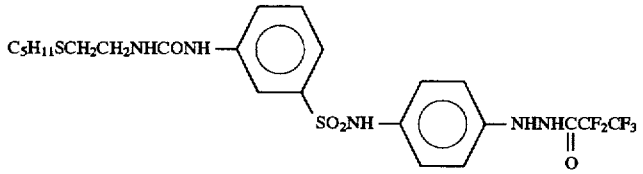
I-46
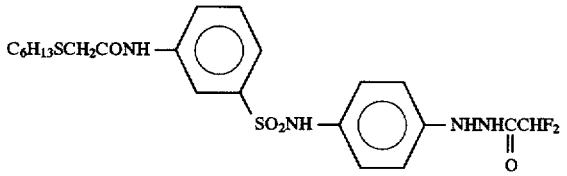
I-47
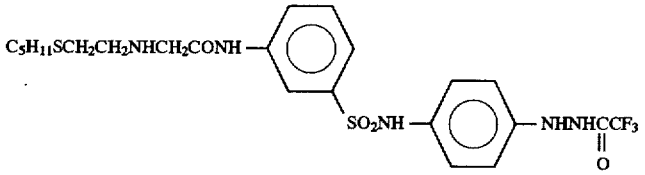
I-48
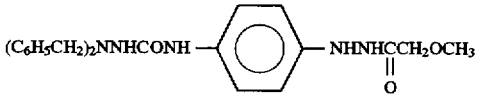
I-49
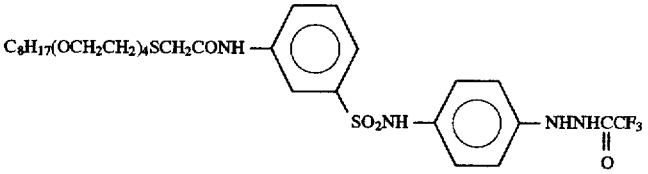
I-50
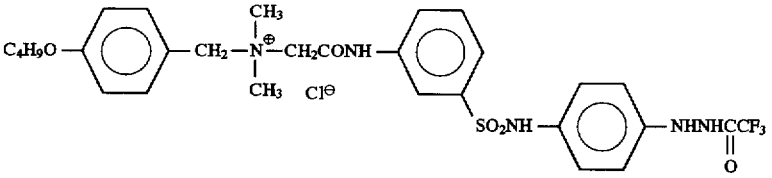
I-51
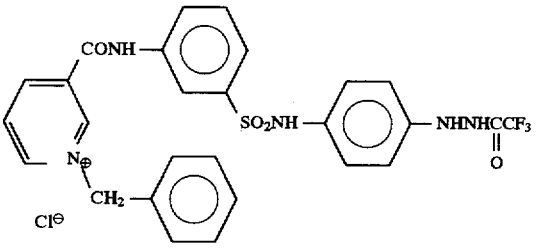

-continued
I-52
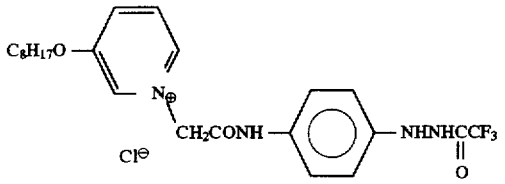
I-53
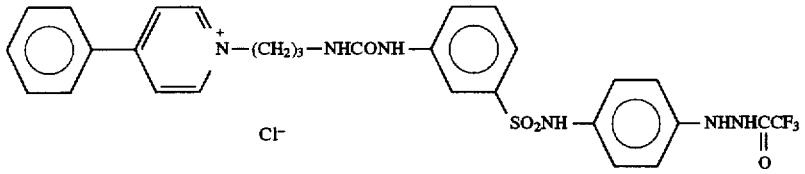
I-54
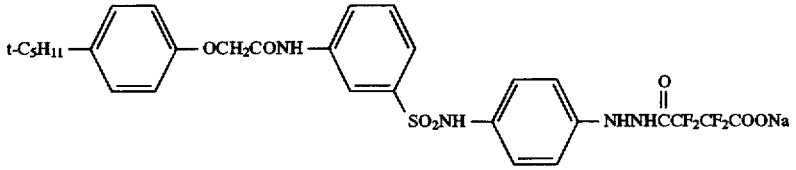
I-55
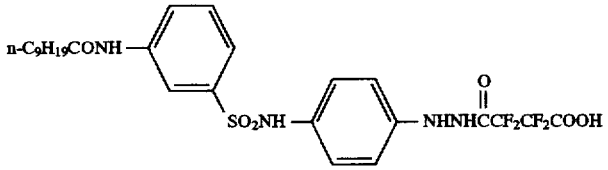
I-56
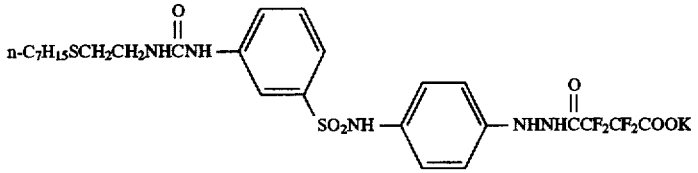
I-57
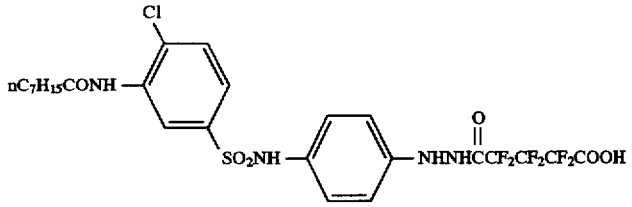
I-58
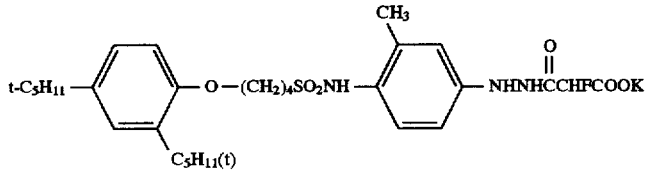
I-59
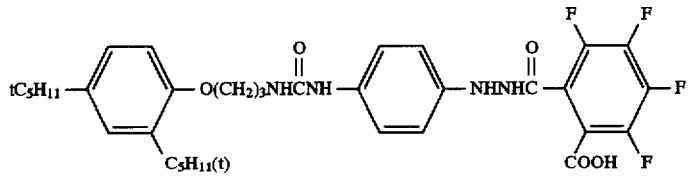

-continued
I-60
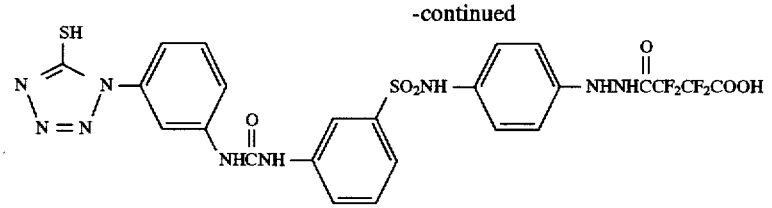
I-61
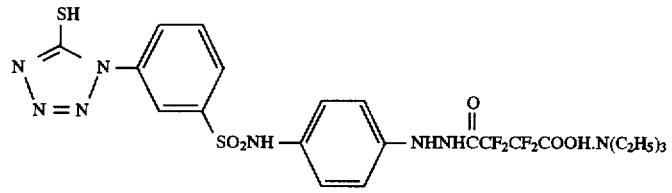
I-62
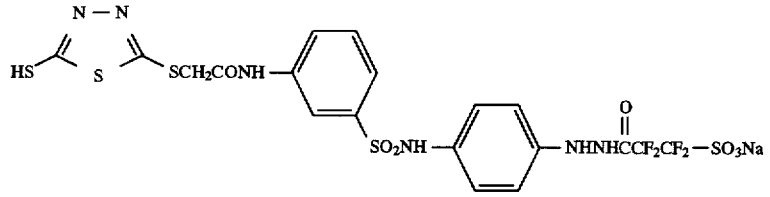
I-63
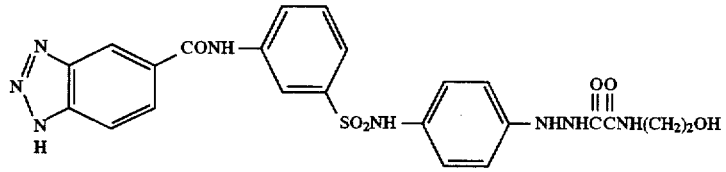
I-64
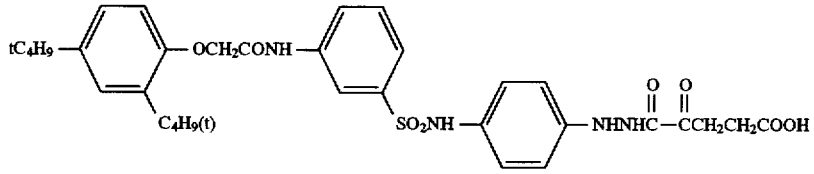
I-65
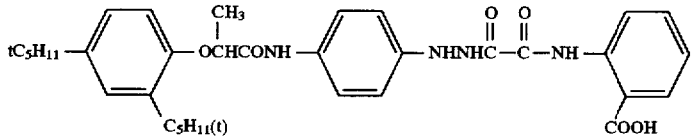
I-66
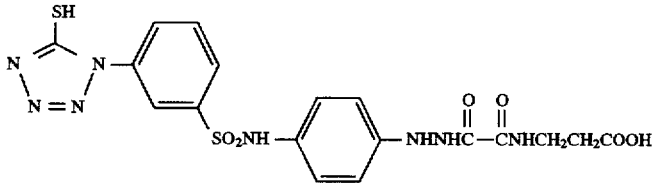
I-67
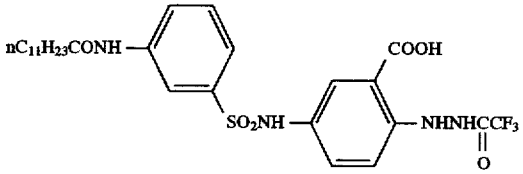
I-68
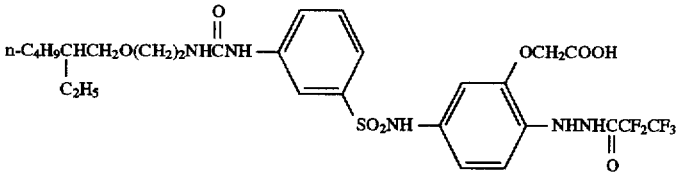

-continued
I-69
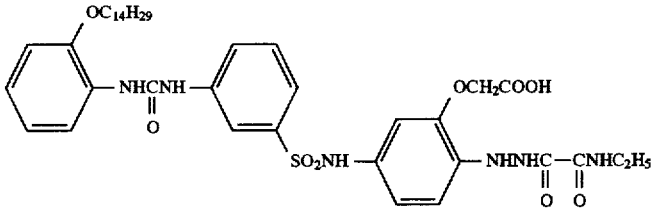
I-70
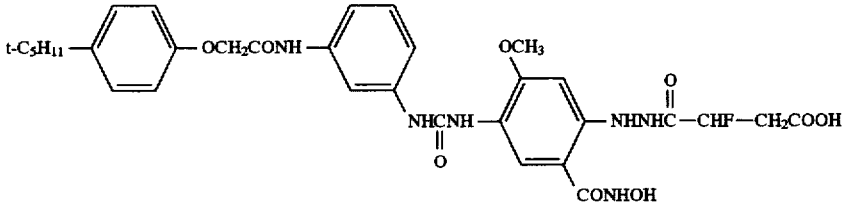
I-71
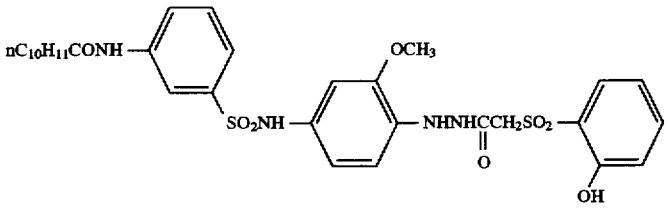
I-72
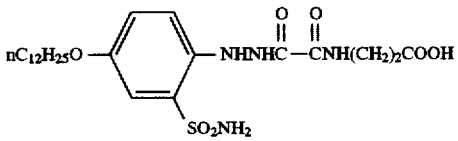
I-73
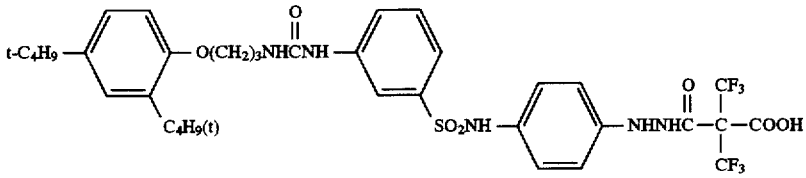
I-74
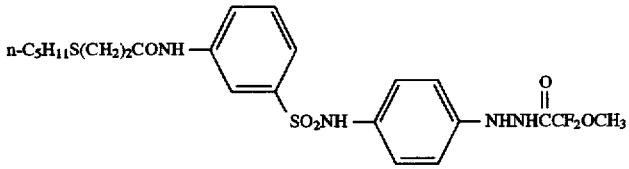
I-75
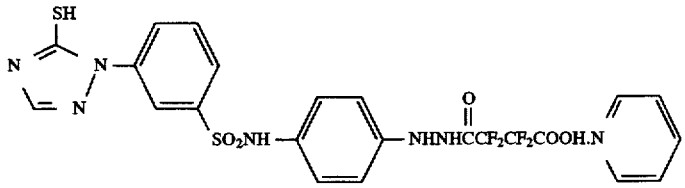
I-76
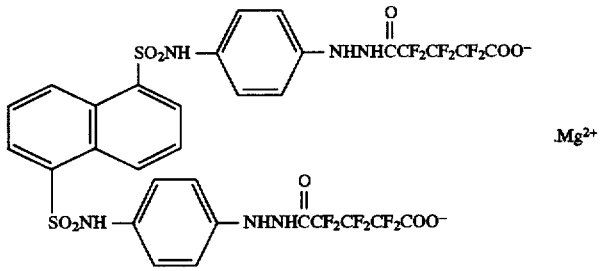

-continued

I-77

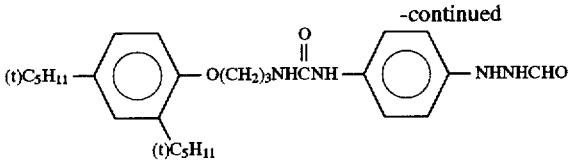

I-78

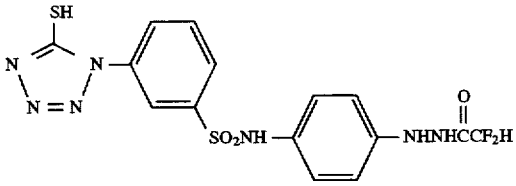

I-79

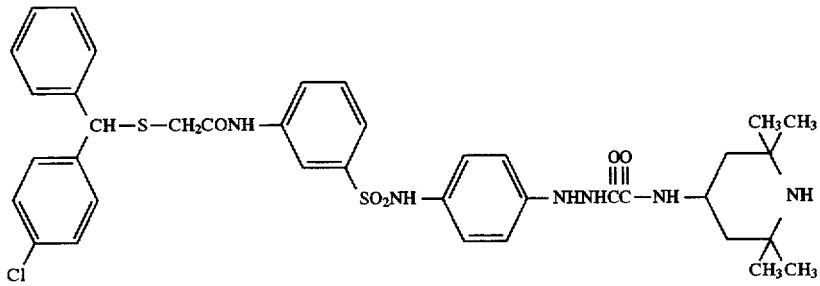

In addition to those described above, the hydrazine derivatives for use in the present invention include those described in *Research Disclosure*, Item 23516, p. 346 (November, 1983) and literatures cited therein, U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355 and 5,104,769, British Patent 2,011,391B, European Patents 217,310, 301,799 and 356,898, JP-A-60-179734, JP-A-61-170733, JP-A-61-270744, JP-A-62-178246, JP-A-62-270948, JP-A-63-29751, JP-A-63-32538, JP-A-63-104047, JP-A-63-121838, JP-A-63-1298337, JP-A-63-223744, JP-A-63-234244, JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764, JP-A-5-45765 and JP-A-6-289524.

The addition amount of the hydrazine derivative of the present invention is preferably from $1\times10^{-6}$ to $5\times10^{-2}$ mol, more preferably from $1\times10^{-5}$ to $2\times10^{-2}$ mol, per mol of silver halide.

The hydrazine derivative of the present invention may be used by dissolving it in an appropriate water-miscible organic solvent, such as alcohols (e.g., methanol, ethanol, propanol, fluorinated alcohol), ketones (e.g., acetone, methyl ethyl ketone), dimethylformamide, dimethylsulfoxide or methyl cellosolve.

Also, it may be used by dissolving it by a well-known emulsion-dispersion method using an oil such as dibutyl phthalate, tricresyl phosphate, glyceryl triacetate or diethyl phthalate, or an auxiliary solvent such as ethyl acetate or cyclohexanone, and then mechanically forming the solution into an emulsified dispersion. Moreover, it may be used by dispersing a hydrazine derivative powder in water using a ball mill, a colloid mill or an ultrasonic wave according to a method known as a solid dispersion method.

Furthermore, as described in JP-A-2-948, it may be used by incorporating it into a polymer fine grain.

The silver halide photographic material of the present invention may contain a nucleation accelerator such as an amine derivative, an onium salt, a disulfide derivative and a hydroxymethyl derivative, in a silver halide emulsion layer or other hydrophilic colloid layer.

Examples of the amine derivative for use in the present invention include compounds described in JP-A-60-140340, JP-A-62-50829, JP-A-62-222241, JP-A-62-250439, JP-A-62-280733, JP-A-63-124045, JP-A-63-133145 and JP-A-63-286840. The amine derivative is more preferably a compound having a group which adsorbs onto silver halide described in JP-A-63-124045, JP-A-63-133145 and JP-A-63-286840, or a compound having 20 or more carbon atoms in total described in JP-A-62-222241.

The onium salt for use in the present invention is preferably an ammonium salt or a phosphonium salt. Preferred examples of the ammonium salt include the compounds described in JP-A-62-250439 and JP-A-62-280733. Preferred examples of the phosphonium salt include the compounds described in JP-A-61-167939 and JP-A-62-280733.

Examples of the disulfide derivative for use in the present invention include those described in JP-A-61-198147.

Examples of the hydroxymethyl derivative for use in the present invention include the compounds described in U.S. Pat. Nos. 4,693,956 and 4,777,118, European Patent 231850 and JP-A-62-50829, and the hydroxymethyl derivative is more preferably a diarylmethanol derivative.

Examples of the nucleation accelerator which is particularly useful include compounds represented by formulae (IV) to (VIII) of JP-A-7-287338, more specifically, Compounds IV-1 to IV-36, V-1 to V-22, VI-1 to VI-36, and VIII-1 to VIII-41, and compounds represented by formulae (A) to (D), more specifically, Compounds A-101 to A-147 and A-201 to A-255. Specific examples of the compound as the nucleation accelerating agent for use in the present invention are set forth below, however, the present invention is by no means limited thereto.

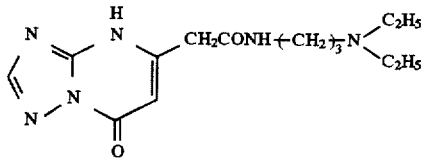
A-1)

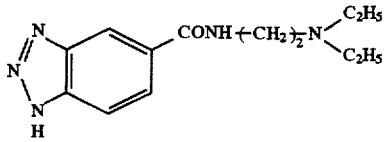
A-2)

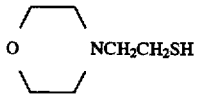
A-3)

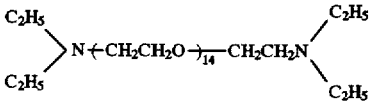
A-4)

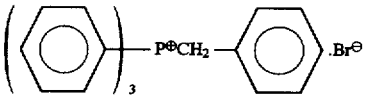
A-5)

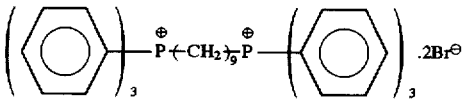
A-6)

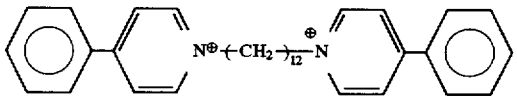
A-7)

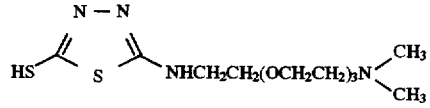
A-8)

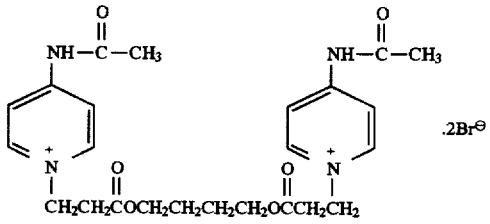
A-9)

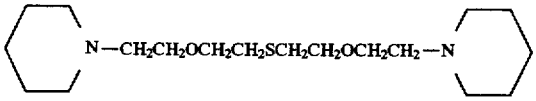
A-10)

The optimal addition amount of these compounds may vary depending upon the kind; however, it is preferably from $1.0\times10^{-2}$ to $1.0\times10^{2}$ mol per mol of the hydrazine compound.

The compound is dissolved in an appropriate solvent (e.g., $H_2O$, alcohols such as methanol and ethanol, acetone, dimethylformamide, methyl cellosolve) before adding it to a coating solution.

These compounds may be used in combination.

In the silver halide emulsion for use in the present invention, various spectral sensitizing dyes may be used for the purpose of imparting a desired spectral sensitivity. The dye which can be used includes a cyanine dye, a merocyanine dye, a complex cyanine dye, a complex merocyanine dye, a holopolarcyanine dye, a hemicyanine dye, a styryl dye and a hemioxonol dye. The dyes belonging to a cyanine dye, a merocyanine dye and a complex merocyanine dye are particularly useful. Examples of the useful sensitizing dye for use in the present invention include those described in *Research Disclosure*, Item 17643, Item IV-A, p. 23 (December, 1978), ibid., Item 1831X, p. 437 (August, 1978) and literatures cited therein.

A sensitizing dye having spectral sensitivity suitable for the spectral characteristics of various scanner light sources may be advantageously selected.

For example, A) for the argon laser light source, simple merocyanines described in JP-A-60-162247, JP-A-2-48653, U.S. Pat. No. 2,161,331, West German Patent 936,071 and JP-A-5-11389, B) for the helium-neon laser light source, trinuclear cyanine dyes described in JP-A-50-62425, JP-A-54-18726 and JP-A-59-102229, C) for an LED light source and a red semiconductor laser, thiacarbocyanines described in JP-B-48-42172, JP-B-51-9609, JP-B-55-39818, JP-A-62-284343 and JP-A-2-105135, and D) for an infrared semiconductor laser light source, tricarbocyanines described in JP-A-59-191032 and JP-A-60-80841, and dicarbocyanines containing a 4-quinoline nucleus represented by formulae (IIIa) and (IIIb) described in JP-A-59-192242 and JP-A-3-67242 may be advantageously selected.

These sensitizing dyes may be used individually or in combination, and the combination of sensitizing dyes is often used for the purpose of supersensitization. In combination with the senistizing dye, a dye which itself has no spectral sensitization effect or a material which absorbs substantially no visible light, but exhibits supersensitization may be incorporated into the emulsion.

Useful sensitizing dyes, combinations of dyes which exhibit supersensitization, and materials which show supersensitization are described in *Research Disclosure*, Vol. 176, 17643, p. 23, Item IV-J (December, 1978).

With respect to the content of the sensitizing dye of the present invention, an optimal amount is preferably selected according to the grain size, the halogen composition and the way and degree of chemical sensitization of the silver halide emulsion, the relation between the layer where the compound is incorporated and the silver halide emulsion, and the kind of the antifiggant compound. The test methods for the selection are well known by one skilled in the art. In usual, the sensitizing dye is used in an amount of from $10^{-7}$ to $1\times10^{-2}$ mol, more preferably $10^{-6}$ to $5\times10^{-3}$ mol, per mol of silver halide.

Gelatin is advantageously used as a protective colloid of the photographic emulsion or as a binder in other hydrophilic colloidal layers of the emulsion layer; however, other hydrophilic colloids may also be used. Examples thereof include proteins such as gelatin derivatives, graft polymers of gelatin to other polymer, albumin and casein; cellulose derivatives such as hydroxyethyl cellulose, carboxymethyl cellulose and cellulose sulfate; saccharide derivatives such as sodium arginate and starch derivative; and various synthetic hydrophilic polymer materials such as homopolymers and copolymers of polyvinyl alcohol, polyvinyl alcohol partial acetal, poly-N-vinylpyrrolidone, polyacrylic acid, polymethacrylic acid, polyacrylamide, polyvinyl imidazole or polyvinyl pyrazole.

The gelatin may be a lime-processed gelatin or an acid-processed gelatin, and a hydrolysate or an enzymolysate of gelatin may also be used.

The photographic material of the present invention may contain various compounds so as to prevent fogging or to stabilize photographic capabilities, during preparation, storage or photographic processing of the photographic material. More specifically, a large number of compounds known as an antifoggant or a stabilizer may be added. Examples thereof include azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles and nitrobenzotriazoles; mercaptopyrimidines; mercaptotriazines; thioketo compounds, e.g., oxazolinethione; and azaindenes, e.g., triazaindenes, tetrazaindenes (in particular, 4-hydroxy-substituted (1,3,3a,7)tetrazaindenes) and pentazaindenes; hydroquinone and derivatives thereof; disufides such as thioctic acid; and benzenethiosulfonic acid, benzenesulfinic acid and benzenesulfonic acid amide. Among these, preferred are benzotriazoles (e.g., 5-methylbenzotriazole) and nitroindazoles (e.g., 5-nitroindazole). These compounds may also be incorporated into a processing solution.

With respect to various additives for use in the photographic material of the present invention, there is no particular limitation and for example, those described in the following may be preferably used.

(1) Surface active agent

JP-A-2-12236, page 9, from right upper column, line 7 to right lower column, line 7; and JP-A-2-18542, from page 2, left lower column, line 13 to page 4, right lower column, line 18

(2) Antifoggant

JP-A-2-103536, from page 17, right lower column, line 19 to page 18, right upper column, line 4, and right lower column, lines 1 to 5; and thiosulfinic acid compounds described in JP-A-1-237538

(3) Polymer latex

JP-A-2-103536, page 18, left lower column, lines 12 to 20

(4) Compound having an acid group

JP-A-2-103536, from page 18, right lower column, line 6 to page 19, left upper column, line 1

(5) Matting agent, sliding agent and plasticizer

JP-A-2-103536, page 19, from left upper column, line 15 to right upper column, line 15

(6) Hardening agent

JP-A-2-103536, page 18, right upper column, lines 5 to 17

(7) Dye

Dyes described in JP-A-2-103536, page 17, right lower column, lines 1 to 18; and solid dyes described in JP-A-2-294638 and JP-A-5-11382

(8) Binder

JP-A-2-18542, page 3, right lower column, lines 1 to 20

(9) Black pepper inhibitor

Compounds described in U.S. Pat. No. 4,956,257 and JP-A-1-118832

(10) Monomethine compound

Compounds represented by formula (II) (in particular, Compounds II-1 to II-26) of JP-A-2-287532

(11) Dihydroxybenzenes

Compounds described in JP-A-3-39948, from page 11, left upper column to page 12, left lower column and EP 452772A The developer in the course of developing the photographic material according to the present invention may contain additives which are usually utilized (e.g., developing agents, alkaline agents, pH buffers, preservatives, chelating agents). The developing may be carried out according to any known methods. Any known developers may be used in the developing processing.

The developing agent for use in the developer of the present invention is not particularly limited; however, developing agents containing dihydroxybenzenes or ascorbic acid derivatives are preferred. More preferably, a combination of dihydroxybenzenes and 1-phenyl-3-pyrazolidones, a combination of dihydroxybenzenes and p-aminophenols, a combination of ascorbic acid derivatives and 1-phenyl-3-pyrazolidones, and a combination of ascorbic acid derivatives and p-aminophenols are more preferred because of their good developing ability.

Examples of the dihydroxybenzene developing agent for use in the present invention include hydroquinone, chlorohydroquinone, isopropylhydroquinone, methylhydroquinone, and hydroquinone monosulfonate, with hydroquinone being particularly preferable.

Examples of the ascorbic acid derivative for use in the present invention include ascorbic acid, erythorbic acid, which is a stereo isomer of ascorbic acid, and these alkali metal salts (e.g., sodium salts, potassium salts).

Examples of the 1-phenyl-3-pyrazolidone developing agent and derivatives thereof for use in the present invention include 1-phenyl-3-pyrazolidone, 1-phenyl-4,4-dimethyl-3-pyrazolidone, and 1-phenyl-4-methyl-4-hydroxymethyl-3-pyrazolidone.

Examples of the p-aminophenol developing agent for use in the present invention include N-methyl-p-aminophenol, p-aminophenol, N-(β-hydroxyethyl)-p-aminophenol, and N-(4-hydroxyphenyl)glycine. Among these, N-methyl-p-aminophenol is preferred.

It is preferred that the dihydroxybenzene developing agent is used in an amount of from 0.05 to 0.8 mol/l, preferably from 0.2 to 0.6 mol/l. When the combination of the dihydroxybenzene with 1-phenyl-3-pyrazolidone or p-aminophenol is used as a developing agent, it is preferred that the former is used in an amount of from 0.05 to 0.6 mol/l, preferably 0.2 to 0.5 mol/l, and the latter is used in an amount of 0.06 mol/l or less, preferably 0.03 mol/l or less.

It is preferred that the ascorbic acid derivative developing agent is used in an amount of from 0.05 to 0.8 mol/l, preferably from 0.2 to 0.6 mol/l. When the combination of the ascorbic acid derivative with 1-phenyl-3-pyrazolidone or p-aminophenol is used as a developing agent, it is preferred that the former is used in an amount of from 0.05 to 0.6 mol/l, preferably 0.2 to 0.5 mol/l, and the latter is used in an amount of 0.06 mol/l or less, preferably 0.03 mol/l or less.

Examples of the preservatives for use in the present invention include sodium sulfite, potassium sulfite, lithium sulfite, ammonium sulfite, sodium bisulfite, sodium metasulfite, and formaldehyde-sodium bisulfite. The sulfite is used in an amount of 0.20 mol/l or more, and preferably 0.30 mol/l or more, but if it is added too excessively, there is a cause for silver staining in the developer. Accordingly, the upper limit is preferably 1.2 mol/l. The amount is more preferably from 0.35 to 0.7 mol/l.

In combination with the sulfite, a small amount of an ascorbic acid derivative may be added as a preservative for the dihydroxybenzene developing agent. Examples of the ascorbic acid derivative as a preservative include ascorbic acid, erythorbic acid, which is a stereo isomer of ascorbic acid, and these alkali metal salts (e.g., sodium salts, potassium salts). Preference is given to the use of sodium erythorbate in terms of the cost for material. The concentration ratio of the addition amount thereof to the amount of the dihydroxybenzene developing agent by mol is preferably from 0.03/1 to 0.12/1, more preferably from 0.05/1 to 0.10/1. In using the ascorbic derivative as a preservative, it is preferable to contain no boron compound in the developer.

Alkali agents which can be used for setting the pH include usual water-soluble inorganic alkali metal salts (e.g., sodium hydroxide, potassium hydroxide, sodium carbonate, potassium carbonate).

Examples of additives added to the developer of the present invention include a development inhibitor (e.g., sodium bromide, potassium bromide), an organic solvent (e.g., ethylene glycol, diethylene glycol, triethylene glycol, dimethylformamide), an alkanolamine (e.g., diethanolamine, triethanolamine), a development accelerator (e.g., imidazole, derivatives thereof), and an antifoggant or black pepper (black spot) inhibitor (e.g., mercapto compound, indazole compound, benzotriazole compound, benzimidazole compound). Specific examples include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]butanesulfonate, 5-amino-1,3,4-thiadiazole-2-thiol, methylbenzotriazole, 5-methylbenzotriazole and 2-mercaptobenzotriazole. The addition amount of the antifoggant is from 0.01 to 10 mmol, more preferably from 0.1 to 2 mmol, per liter of the developer.

Furthermore, various kinds of organic and inorganic chelating agents can be used in combination in the developer of the present invention. Examples of the inorganic chelating agents include sodium tetrapolyphosphate and sodium hexametaphosphate.

Examples of the organic chelating agents include organic carboxylic acid, aminopolycarboxylic acid, organic phosphonic acid, aminophosphonic acid, and organic phosphonocarboxylic acid.

Examples of the organic carboxylic acids include acrylic acid, oxalic acid, malonic acid, succinic acid, glutaric acid, adipic acid, pimelic acid, suberic acid, acielaidic acid, sebacic acid, nonanedicarboxylic acid, decanedicarboxylic acid, undecanedicarboxylic acid, maleic acid, itaconic acid, malic acid, citric acid, and tartaric acid.

Examples of the aminopolycarboxylic acids include iminodiacetic acid, nitrilotriacetic acid, nitrilotripropionic acid, ethylenediaminemonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminotetraacetic acid, and compounds disclosed in JP-A-52-25632, JP-A-55-67747, JP-A-57-102624, and JP-B-53-40900.

Examples of the organic phosphonic acids include hydroxyalkylidene-diphosphonic acid disclosed in U.S. Pat. Nos. 3,214,454, 3,794,591 and German Patent Publication No. 2,227,639, and the compounds disclosed in *Research Disclosure*, Vol. 181, Item 18170 (May, 1979).

Examples of the aminophosphonic acids include aminotris(methylenephosphonic acid), ethylenediaminotetramethylenephosphonic acid, aminotrimethylenephosphonic acid, and the compounds disclosed in *Research Disclosure*, No. 18170, JP-A-57-208554, JP-A-54-61125, JP-A-55-29883 and JP-A-56-97347.

Examples of the organic phosphonocarboxylic acids include the compounds disclosed in JP-A-52-102726, JP-A-53- 42730, JP-A-54-121127, JP-A-55-4024, JP-A-55-4025, JP-A-55-126241, JP-A-55-65955, and *Research Disclosure*, No. 18170.

These chelating agents may be used in the form of alkali metal salts or ammonium salts. The addition amount of these chelating agents is preferably from $1\times10^{-4}$ to $1\times10^{-1}$ mol, more preferably from $1\times10^{-3}$ to $1\times10^{-2}$ mol, per liter of the developer.

Furthermore, the developer for use in the present invention can contain the compounds disclosed in JP-A-56-24347, JP-B-56-46585, JP-B-62-2849, and JP-A-4-362942 as a silver stain inhibitor.

Also, the developer for use in the present invention can contain the compounds disclosed in JP-A-62-212651 as a development unevenness inhibitor, and the compounds disclosed in JP-A-61-267759 as a dissolving aid.

Moreover, the developer may contain a color toning agent, a surfactant, a defoaming agent, and a hardener, if needed.

The developer for use in the present invention may contain carbonates, boric acids such as boric acid, borax, methaboric acid, potassium boric acid as disclosed in JP-A-62-186259, saccharides (e.g., saccharose) as disclosed in JP-60-93433, oximes (e.g., acetoxime), phenols (e.g., 5-sulfosalicylic acid), tertiary phosphates (e.g., sodium tertiary phosphate, potassium tertiary phosphate) or aluminum salts (e.g., sodium salt) as a buffer. The carbonates and borates are preferred as a buffer.

The developer for use in the present invention preferably has a pH of from 9.5 to 11.0, and more preferably from 9.8 to 11.0.

The development processing temperature and the development processing time are related reciprocally and determined in relationship with the total processing time, and generally the processing temperature is from about 20° to 50° C., preferably from 25° to 45° C., and the processing time is from 5 seconds to 2 minutes, preferably from 7 seconds to one minute and 30 seconds.

The replenishment rate of the developing solution is 500 ml or less, preferably 400 ml or less, per $m^2$ of a silver halide black-and-white photographic material.

Preferably, the processing solution is concentrated for preservation and is diluted when it is used in order to save the transportation cost, package material cost and spaces. The salt component contained in the developer is preferably a potassium salt to concentrate the developer.

The fixing solution for use in the fixing step in the present invention is an aqueous solution containing sodium thiosulfate and ammonium thiosulfate, and if needed, tartaric acid, citric acid, gluconic acid, boric acid, iminodiacetic acid, 5-sulfosalicylic acid, glucohepatic acid, Tiron, ethylenediaminetetraacetic acid, diethylenetriaminepentaacetic acid, nitrilo triacetic acid, and salts thereof. However, it is preferred that the boric acid is not contained in view of the environmental preservation.

Examples of the fixing agent in the fixing solution for use in the present invention include sodium thiosulfate and ammonium thiosulfate. The sodium thiosulfate is preferred in view of the fixing velocity and the sodium thioammonium is preferred in view of the environmental preservation. The amount added of the fixing agent is not particularly limited, but is generally from about 0.1 to 2 mol/l, and particularly preferably from 0.2 to 1.5 mol/l.

The fixing solution can include, if needed, a hardening agent (e.g., water-soluble aluminum compound), a preservative (e.g., sulfite, bisulfite), a pH buffer (e.g., acetic acid), a pH adjustor (e.g., ammonia, sulfuric acid), a chelating agent a surfactant, a wetting agent, and a fixing accelerator.

Examples of the surfactant include an anionic surfactant (e.g., sulfated product, sulfonated product), a polyethylene surfactant, and amphoteric surfactants disclosed in JP-A-57-6840, and known defoaming agents can also be used. Examples of the wetting agent include alkanolamine and alkylene glycol. Examples of the fixing accelerator include thiourea derivatives disclosed in JP-B-45-35754, JP-B-58-122535 and JP-B-58-122536, alcohol having a triple bond in the molecule, thioether compounds disclosed in U.S. Pat. No. 4,126,459, mesoionic compounds disclosed in JP-A-4-229860, and compounds disclosed in JP-A-2-44355.

Examples of the pH buffer for use in the fixing solution include an organic acid such as acetic acid, malic acid, succinic acid, tartaric acid, citric acid, maleic acid, glycol acid and adipic acid, an inorganic acid such as boric acid, phosphate and sulfite. Among these, preferred are acetic acid, tartaric acid, and sulfite.

The pH buffer is used so as to inhibit the pH increase of the fixing solution by incorporation of the developer. The pH buffer is used in an amount of from 0.01 to 1.0 mol/l, preferably from 0.02 to 0.6 mol/l.

The pH of the fixing solution is preferably from 4.0 to 6.5, more preferably from 4.5 to 6.0.

As a dye dissolution accelerator, the compounds disclosed in JP-A-64-4739 can be used.

As a hardener in the fixing solution for use in the present invention, water-soluble aluminum salts and chromium salts are used. The water-soluble ammonium salt is preferred and examples thereof include aluminum chloride, aluminum sulfate and potassium alum. The amount added of the pH buffer is preferably from 0.01 to 0.2 mol/l, more preferably from 0.03 to 0.08 mol/l.

The fixing temperature is from about 20° to 50° C., preferably from 25° to 45° C.; and the fixing time is from 5 seconds to one minute, preferably from 7 to 50 seconds.

The replenishing amount of the fixing solution is preferably 600 ml or less, more preferably 500 ml or less, per $m^2$ of the processed photographic material.

In the photographic processing method of the present invention, the photographic material is processed with washing water or a stabilizing solution after the development and fixation steps, and then dried.

Generally, the washing or stabilizing step is conducted in a washing water amount of 20 liter or less per $m^2$ of silver halide photographic material. It is possible to perform the washing or stabilizing step using washing water or a stabilizing solution at a replenishment rate of at most 3 liter of a replenisher per $m^2$ of silver halide photographic material (including the replenishment rate of zero, namely the washing with stored water). That is, not only economizing water in the washing step but also making a piping work unnecessary in setting up an automatic developing machine becomes possible.

As a method for reduction in replenishment of washing water, the multistage (e.g., two-stage, three-stage) counter current process has been known for a long time. If this process is applied to the present invention, the fixation-processed photographic material is processed as it is brought into contact with successive, more and more cleaned processing solutions, that is, processing solutions less and less contaminated with the fixer. Accordingly, more efficient washing can be carried out.

When the washing step is performed with a small amount of water, it is preferable to use a washing tank equipped with squeeze rollers or crossover rollers, as disclosed in JP-A-63-18350 and JP-A-62-287252. Furthermore, the addition of various kinds of oxidizing agents and the filtration may be supplemented for the purpose of reduction in pollution load. An increase in pollution load is a big problem that the washing with little water faces.

Also, in the present invention, part or all of the overflow generated from the washing or stabilizing bath by replenishing the bath with the water, which is rendered moldproof by the above-cited means, in proportion as the processing proceeds can be used in the prior step wherein the processing solution having a fixability is used, as described in JP-A-60-235133.

Moreover, a water-soluble surfactant or a defoaming agent may be included in washing water to prevent generation of irregular foaming which is liable to generate when washing is conducted with a small amount of water and/or to prevent components of the processing agents adhered to a squeegee roller from transferring to the processed film.

In addition, dye adsorbents disclosed in JP-A-63-163456 may be included in a washing tank to inhibit contamination by dyes dissolved from photographic materials.

When a photographic material is subjected to stabilizing processing after the washing processing, bath containing compounds disclosed in JP-A-2-201357, JP-A-2-132435, JP-A-1-102553 and JP-A-46-44446 may be used as a final bath.

This stabilizing bath may contain, if needed, ammonium compounds, metal compounds such as Bi and Al, brightening agents, various kinds of chelating agents, film pH adjustors, hardening agents, sterilizers, antimold agents, alkanolamines, and surfactants. Tap water, deionized water, and water sterilized by a halogen, ultraviolet sterilizing lamp or various oxidizing agents (e.g., ozone, hydrogen peroxide, chlorate) or tap water containing the compounds disclosed in JP-A-4-39652 and JP-A-5-241309 are preferably used as washing water in a washing step or a stabilizing step.

The temperature and time of the washing and stabilizing bath processing are preferably from 0° to 50° C. and from 5 seconds and 2 minutes.

The processing solution used in the present invention is preferably stored in a package material slightly pervious to oxygen as disclosed in JP-A-61-73147.

The processing solution for use in the present invention may form a powder agent or a solid material. The formation may be carried out by known methods, and the methods disclosed in JP-A-61-259921, JP-A-4-85533 and JP-A-16841 are preferred, and the method disclosed in JP-A-61-259921 is particularly preferred.

When the replenishing amount is lowered, the evaporation and air oxidation of the solution are inhibited by reducing the contact area of the solution and the air of the solution tank. Automatic developing machines of roller conveyance type are described in, e.g., U.S. Pat. Nos. 3,025,779 and 3,545,971, and the present invention refers them to simply as processors of roller conveyance type. A processor of roller conveyance type involves four processes, namely development, fixation, washing and drying processes. Also, it is most advantageous for the present method to follow those four processes, although the present method does not exclude other processes (e.g., stop process). The four processes may contain a stabilizing step in place of the washing step.

The present invention will be described below in greater detail by referring to Examples, but the present invention should not be construed as being limited thereto.

EXAMPLE 1

Preparation of Silver Halide Photographic Light-Sensitive Material

Preparation of Emulsion

[Emulsion A]

| | |
|---|---|
| Solution 1: | |
| Water | 1,000 ml |
| Gelatin | 20 g |
| Sodium chloride | 2 g |
| 1,3-Dimethylimidazolidine-2-thione | 20 mg |
| Sodium benzenethiosulfonate | 8 mg |
| Solution 2: | |
| Water | 400 ml |
| Silver nitrate | 100 g |
| Solution 3: | |
| Water | 400 ml |
| Sodium chloride | 43.5 g |
| Potassium bromide | 14 g |

To Solution 1 kept at 38° C. and a pH of 4.5, Solution 2 and Solution 3 each in an amount corresponding to 90% were added simultaneously over 20 minutes while stirring to form core grains having a size of 0.19 μm. Subsequently, Solution 4 and Solution 5 described below were added over 8 minutes and then Solution 2 and Solution 3 each in an amount corresponding to the remaining 10% were added over 2 minutes to obtain silver chlorobromide grains having an average grain size of 0.22 μm and a silver chloride content of 70 mol %.

| | |
|---|---|
| Solution 4: | |
| Water | 100 ml |
| Silver nitrate | 50 g |
| Solution 5: | |
| Water | 100 ml |
| Sodium chloride | 14 g |
| Potassium bromide | 11 g |

Thereafter, $1\times10^{-3}$ mol of a KI solution was added to resulting emulsion to effect conversion, then the emulsion was washed with water by a flocculation method in a usual manner, 40 g/mol-Ag of gelatin was added thereto, further 7 mg/mol-Ag of sodium benzenethiosulfonate and 2 mg/mol-Ag of sodium benzenesulfinate were added, the pH and the pAg were adjusted to 5.7 and 7.5, respectively, and the emulsion was subjected to chemical sensitization by adding 1 mg/mol-Ag of sodium thiosulfate, Compound (CS-A) and 5 mg of chloroauric acid so as to have optimal sensitivity at 55° C. Then, 150 mg of 4-hydroxy-6-methyl-1,3,3a,7-tetrazaindene as a stabilizer and 100 mg of proxel as an antiseptic were added. The resulting grains had an average grain size of 0.22 μm and each grain was a silver iodochlorobromide cubic grain having a silver chloride content of 70 mol % (coefficient of variation: 10%).

CS-A

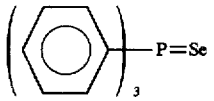

[Emulsions B to L]

Emulsions B to L were prepared thoroughly in the same manner as Emulsion A except for adding a metal complex to Solution 3 and Solution 5 of Emulsion A as shown in Table 1.

TABLE 1

| Emulsion | Dopant | Addition Amount (mol/mol-Ag) |
|---|---|---|
| A | — | — |
| B | $[Cr(CN)_6]^{3-}$ | $5\times10^{-7}$ |
| C | $[Cr(CN)_6]^{3-}$ | $1\times10^{-6}$ |
| D | $[RhCl_5(H_2O)]^{2-}$ | $1\times10^{-7}$ |
| E | $[Ru(NO)Cl_5]^{2-}$ | $1\times10^{-7}$ |
| F | $[Cr(CN)_6]^{3-}$ | $5\times10^{-7}$ |
| | $[IrCl_6]^{3-}$ | $5\times10^{-7}$ |
| G | $[Cr(CN)_6]^{3-}$ | $5\times10^{-7}$ |
| | $[RhCl_5(H_2O)]^{2-}$ | $5\times10^{-8}$ |
| H | $[Cr(CN)_6]^{3-}$ | $5\times10^{-7}$ |
| | $[Ru(NO)Cl_5]^{2-}$ | $5\times10^{-8}$ |
| I | $[Cr(CN)_6]^{3-}$ | $5\times10^{-7}$ |
| | $[ReBr_5(NS)]^{2-}$ | $5\times10^{-8}$ |
| J | $[Cr(CN)_6]^{3-}$ | $5\times10^{-7}$ |
| | $[OsCl_6]^{3-}$ | $5\times10^{-8}$ |
| K | $[Cr(CN)_6]^{-3}$ | $5\times10^{-7}$ |
| | $[Fe(CN)_6]^{4-}$ | $1\times10^{31\ 5}$ |
| L | $[Cr(CN)_6]^{3-}$ | $5\times10^{-7}$ |
| | $[Cr(CN)_6]^{3-}$ | $1\times10^{-5}$ |

Preparation of Coated sample

On a polyethylene terephthalate film support undercoated by a moisture-proofing layer containing vinylidene chloride, an EM layer, a PC layer and an OC layer were coated in this order from the support side to prepare a sample.

The preparation method and the coating amount of each layer are described below.

(EM)

To the emulsion prepared above, $5\times10^{-4}$ mol/mol-Ag of Sensitizing Dye D-1 shown below and 5 mg/mol-Ag of Sensitizing Dye D-2 shown below were added, and further 5 mg/mol-Ag of KBr, $3\times10^{-4}$ mol/mol-Ag of a mercapto compound shown below as Compound (a), $4\times10^{-4}$ mol/mol-Ag of a mercapto compound shown below as Compound (b), $4\times10^{-4}$ mol/mol-Ag of a triazine compound shown below as Compound (c) and $2\times10^{-3}$ mol/mol-Ag of 5-chloro-8-hydroxyquinoline were added. For the purpose of stabilization, 300 mg of disodium 4,4'-bis-(4,6-dinaphthoxypyrimidin-2-ylamino)stilbenedisulfonate and 450 mg of iodide 2,5-dimethyl-3-allylbenzothiazole were added. Then, hydroquinone, dodecylbenzenesulfonato sodium salt, Compound (D) and colloidal silica having an average particle size of 0.02 μm were added to give a coated amount of 100 mg/m$^2$, 20 mg/m$^2$, 20 mg/m$^2$, 15 mg/m$^2$ and 200 mg/m$^2$, respectively. Further, 200 mg/m$^2$ of a water-soluble latex shown below as Compound (e), 200 mg/m$^2$ of a polyethyl acrylate dispersion, 200 mg/m$^2$ of a latex copolymer of methyl acrylate, sodium 2-acrylamido-2-methylpropanesulfonate and 2-acetoacetoxyethyl methacrylate (weight ratio: 88:5:7) were added. Then, 200 mg/m$^2$ of 1,3-divinylsulfonyl-2-propanol was added as a hardening agent. The pH of the resulting solution was adjusted to 5.5 by adding an acetic acid. The solution was coated to give a silver coated amount of 3.5 g m$^2$ and a gelatin coverage of 1.5 g/m$^2$.

(PC)

Gelatin (0.5 g/m$^2$), 250 mg/m$^2$ of a polyethyl acrylate dispersion, 5 mg/M$^2$ of sodium ethylsulfonate and 10 mg/M$^2$ of 1,5-dihydroxy-2-benzaldoxime were coated.

(OC)

Gelatin (0.3 g/m$^2$), 40 mg/M$^2$ of an amorphous $SiO_2$ matting agent having an average particle size of about 3.5 μm, 100 mg/M$^2$ of colloidal silica having an average particle size of 0.02 μm, 100 mg/M$^2$ of methanol silica, 100 mg/M$^2$ of polyacrylamide, 20 mg/M$^2$ of silicone oil, 30 mg/m$^2$ of Compound (f) shown below, and as coating aids, 5 mg/M$^2$ of a fluorine surface active agent shown below by chemical formula (g) and 50 mg/m$^2$ of sodium dodecylbenzenesulfonate were coated.

D-1

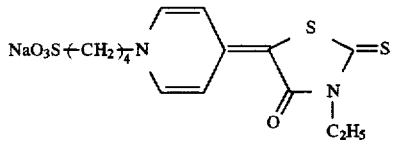

D-2

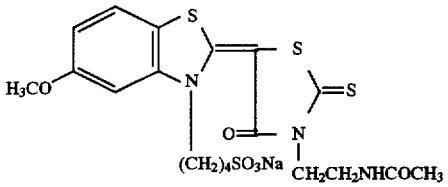

(a)

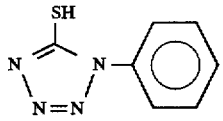

(b)

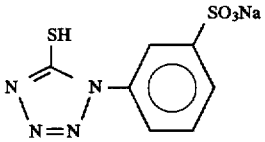

(c)

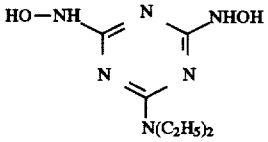

(d)

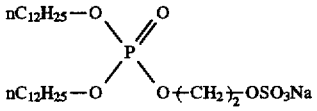

(e)

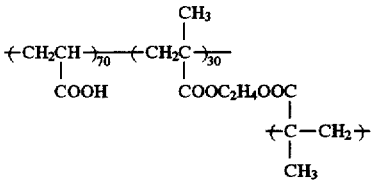

(f)

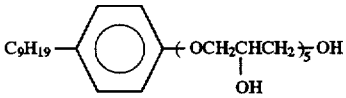

(g)

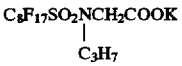

The coated samples each had a back layer and a back protective layer having the following compositions.

[Formulation of back layer]

| | |
|---|---|
| Gelatin | 3 g/m$^2$ |
| Latex: polyethyl acrylate | 2 g/m$^2$ |
| Surface active agent: sodium p-dodecylbenzenesulfonate | 40 mg/m$^2$ |
| Compound [a] shown below | 110 mg/m$^2$ |

-continued

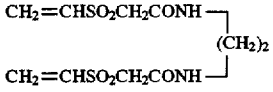

| | |
|---|---|
| $SnO_2$/Sb (weight ratio: 90/10, average particle size: 0.20 μm) | 200 mg/m$^2$ |
| Dye: a mixture of Dyes [a], [b] and [c] | |
| Dye [a] | 100 mg/m$^2$ |
| Dye [b] | 30 mg/m$^2$ |
| Dye [c] | 60 mg/m$^2$ |
| 1,3-Divinylsulfonyl-2-propanol | 200 mg/m$^2$ |

Dye [a]

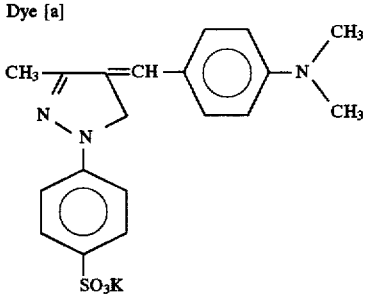

Dye [b]

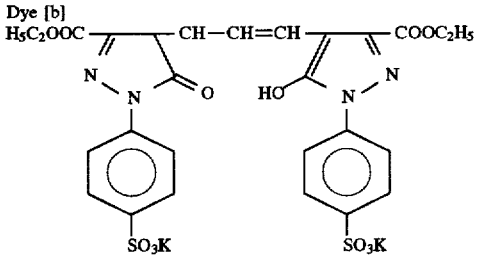

Dye [c]

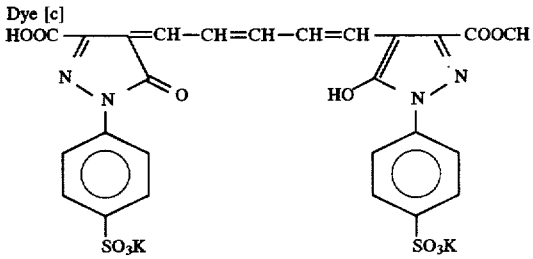

[Back protective layer]

| | |
|---|---|
| Gelatin | 0.8 mg/m$^2$ |
| Polymethyl methacrylate fine particle (average particle size: 4.5 μm) | 30 mg/m$^2$ |
| Sodium dihexyl-α-sulfosuccinate | 15 mg/m$^2$ |
| Sodium p-dodecylbenzenesulfonate | 15 mg/m$^2$ |
| Sodium acetate | 40 mg/m$^2$ |

Exposure and Development (1-1) Evaluation of Photographic Capability

The thus-prepared samples each was exposed to a xenon flash light using a step wedge through an interference filter having a peak at 488 nm for a luminescence time of $10^{-5}$ sec and then developed (at 38° C. for 20 seconds), fixed, water washed and dried in an automatic developing machine FG-680AG manufactured by Fuji Photo Film Co., Ltd. The developer and the fixing solution used each had the following composition.

| Formulation of Developer (Developer A): | |
|---|---|
| Potassium hydroxide | 35.0 g |
| Diethylenetriaminepentaacetic acid | 2.0 g |
| Sodium metabisulfate | 40.0 g |
| Potassium carbonate | 40.0 g |
| Potassium bromide | 3.0 g |
| 5-Methylbenzotriazole | 0.08 g |
| 2,3,5,6,7,8-Hexahydro-2-thioxo-4-(1H)-quinazolinone | 0.04 g |
| Sodium 2-mercaptobenzimidazole-5-sulfonate | 0.15 g |
| Hydroquinone | 25.0 g |
| 4-Hydroxymethyl-4-methyl-1-phenyl-3 pyrazolidone | 0.45 g |
| Sodium erythorbate | 3.0 g |
| Diethylene glycol | 20.0 g |
| Potassium hydroxide and water were added to make 1 l and pH adjusted to 10.45 | |
| Formulation of Fixing Solution (Fixing Solution A): | |
| Ammonium thiosulfate | 119.7 ml |
| Disodium ethylenediaminetetraacetate dihydrate | 0.03 g |
| Sodium thiosulfate pentahydrate | 10.9 g |
| Sodium sulfite | 25.0 g |
| NaOH | 12.4 g |
| Glacial acetic acid | 29.1 g |
| Tartaric acid | 2.92 g |
| Sodium gluconate | 1.74 g |
| Aluminum sulfate | 8.4 g |
| pH (adjusted with sulfuric acid or sodium hydroxide) | 4.8 |
| Water to make | 1 l |

The sensitivity was shown by a relative value to the reciprocal of the exposure amount necessary for giving a density of 1.5, taking the value of Sample 1 as 100, and the larger the value, the higher the sensitivity. With respect to the index (γ) for showing the contrast of an image, a point giving fog+density of 0.3 in a characteristic curve and a point giving fog+density of 3.0 were connected by a straight line and the gradient of the straight line was shown as the γ value. In other words, γ=(3.0−0.3)/[log(exposure amount necessary for giving density of 3.0)−log(exposure amount necessary for giving density of 0.3)], and the larger the γ value, the higher the contrast.

(1-2) Evaluation of Safelight Immunity

Light of 40 lux was illuminated using SLF-1B (safelight for yellow light) manufactured by Fuji Photo Film Co., Ltd. and the time until the fog increased by 0.11 ogE was determined. The larger the value is, the better safelight immunity is.

(1-3) Evaluation of Storage Stability

Each sample was allowed to stand under conditions of 60° C. and 65% RH for 3 days and the photographic properties were evaluated under the conditions in the above item (1-1). The change in sensitivity was shown by a variation taking the sensitivity of the sample when it was allowed to stand at normal temperature for 3 days, as 100.

TABLE 2

| Sample No. | Emulsion | Sensitivity | γ | Safelight Immunity | Storage Stability | Remarks |
|---|---|---|---|---|---|---|
| 1 | A | 100 (Tp) | 4.5 | >20 | +5 | Comparison |
| 2 | B | 82 | 5 | >20 | +5 | " |
| 3 | C | 75 | 6 | >20 | +5 | " |
| 4 | D | 73 | 6 | 10 | +22 | " |
| 5 | E | 50 | 7.5 | 8 | +38 | " |
| 6 | F | 85 | 7 | >20 | +5 | Invention |

TABLE 2-continued

| Sample No. | Emulsion | Sensitivity | γ | Safelight Immunity | Storage Stability | Remarks |
|---|---|---|---|---|---|---|
| 7 | G | 75 | 7.5 | 20 | +6 | " |
| 8 | H | 63 | 8 | 20 | +7 | " |
| 9 | I | 70 | 7.5 | 20 | +6 | " |
| 10 | J | 68 | 7.5 | 20 | +6 | " |
| 11 | K | 90 | 6 | >20 | +5 | " |
| 12 | L | 83 | 6 | >20 | +6 | " |

Results

From the comparison of Sample 1 with Samples 2 and 3, it is seen that by incorporating $[Cr(CN)_6]^{3-}$ into a silver halide emulsion, high contrast can be obtained without deteriorating the safelight immunity and the storage stability. On the review of Samples 6 to 10 of the present invention, it On that by using Ir, Rh, Ru, Re or Os in combination, high contrast can be achieved without deteriorating the safelight immunity and the storage stability. On the other hand, when Rh or Ru is used as in Sample 4 or 5, high contrast may be achieved; however, the reduction in the sensitivity is large and the safelight immunity and the storage stability are worsened. Also, Samples 11 and 12 reveal that by using $[Cr(CN)_6]^{3-}$ in combination with Fe or Co, high sensitivity can be obtained while keeping the high contrast. In other words, it is proved that according to the present invention, a high-sensitive, high-contrast silver halide photographic material excellent in the safelight immunity and reduced in the change in capabilities upon enforced aging can be provided.

EXAMPLE 2

Preparation of Coated Sample

On a polyethylene terephthalate film support undercoated by a moisture-roofing layer containing vinylidene chloride, a UL layer, an EM layer, a PC layer and an OC layer were coated in this order from the support side to prepare a sample.

The preparation method and the coating amount of each layer are described below.

(UL)

As a UL layer, 0.5 g/m$^2$ of gelatin, 150 mg/m$^2$ of a polyethyl acrylate dispersion and 5 mg/m$^2$ of the following dye [d] were coated.

(EM)

To each of Emulsions A to L in Example 1, $5\times10^{-4}$ mol/mol-Ag of Sensitizing Dye D, $5\times10^{-4}$ mol/mol-Ag of Sensitizing Dye D-2, 5 mg/mol-Ag of KBr, $3\times10^{-4}$ mol/mol-Ag of a mercapto compound shown as Compound (a), $4\times10^{-4}$ mol/mol-Ag of a mercapto compound shown as Compound (b), $4\times10^{-4}$ mol/mol-Ag of a triazine compound shown as Compound (c), $2\times10^{-3}$ mol/mol-Ag of 5-chloro-8-hydroxyquinoline, $1\times10^{-4}$ mol/mol-Ag of a hydrazine nucleating agent, and as nucleation accelerators, $4\times10^{-4}$ mol/mol-Ag of Compound A-1 shown below and $^{4\times10-4}$ mol/mol-Ag of Compound A-2 shown below were added. Further, hydroquinone, sodiumN-oleyl-N-methyltaurine, sodiumdodecylbenzenesulfonate, Compound (d) and colloidal silica having an average particle size of 0.02 μm were added to give a coated amount of 100 mg/m$^2$, 20 mg/m$^2$, 20 mg/m$^2$, 15 mg/m$^2$ and 200 mg/m$^2$, respectively. Thereafter, 100 mg/m$^2$ of a water-soluble latex shown as Compound (e), 150 mg/m$^2$ of a polyethyl acrylate dispersion, 150 mg/m$^2$ of a latex copolymer of methyl acrylate, sodium 2-acrylamido-2-methylpropanesulfonate and 2-acetoacetoxyethyl methacrylate (weight ratio: 88:5:7), 150 mg/m$^2$ of a core-shell type latex (core: a styrene/butadiene copolymer (weight ratio: 37/63), shell: a styrene/2-acetoacetoxyethyl methacrylate (weight ratio: 84/16), core/shell ratio=50/50), and 200 mg/m$^2$ of 1,3-divinylsulfonyl-2-propanol as a hardening agent were added. The pH of the resulting solution was adjusted to 5.5 by adding an acetic acid. The solution was coated to give a coated silver amount of 3.5 g/m$^2$ and a gelatin coverage of 1.5 g/m$^2$ .

(PC)

Gelatin (0.5 g/m$^2$), 250 mg/m$^2$ of a polyethyl acrylate dispersion, 5 mg/m$^2$ of sodium ethylsulfonate and 10 mg/m$^2$ of 1,5-dihydroxy-2-benzaldoxime were coated.

(OC)

Gelatin (0.3 g/m$^2$), 40 mg/m$^2$ of an amorphous $SiO_2$ matting agent having an average particle size of about 3.5 μm, 100 mg/m$^2$ of colloidal silica having an average particle size of 0.02 μm, 100 mg/m$^2$ of methanol silica, 100 mg/m$^2$ of polyacrylamide, 20 mg/M$^2$ of silicone oil, 30 mg/m$^2$ of Compound (f), and as coating aids, 5 mg/m$^2$ of a fluorine surface active agent shown as Compound (g) and 50 mg/m$^2$ of sodium dodecylbenzenesulfonate were coated.

Dye [d]

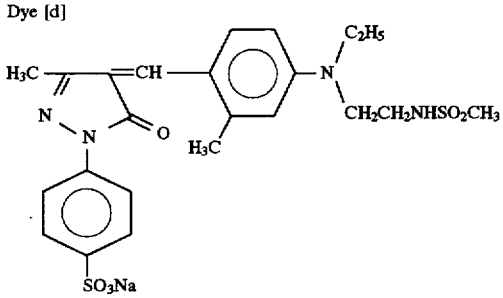

Hydrazine Nucleating Agent (H)

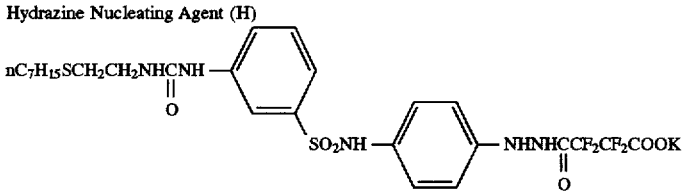

A-1

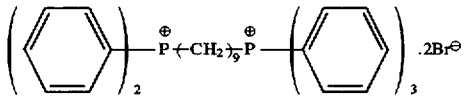

A-2

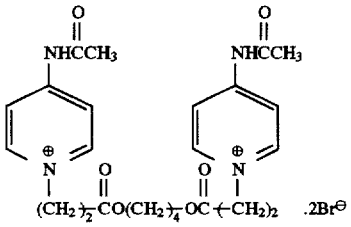

Each coated sample had a back layer and a back protective layer having compositions shown in Example 1.

Exposure and Development (2-1) Evaluation of photographic capability

The thus-prepared samples each was exposed to a xenon flash light using a step wedge through an interference filter having a peak at 488 nm for a luminescence time of $10^{-5}$ sec and then developed (at 35° C. for 30 seconds), fixed, water washed and dried in an automatic developing machine, FG-680A, manufactured by Fuji Photo Film Co., Ltd. The developer and the fixing solution used here were Developer A and Fixing Solution A used in Example 1.

The sensitivity was shown by a relative value to the reciprocal of the exposure amount necessary for giving a density of 1.5, taking the value of Sample 1 as 100, and the larger the value is, the higher the sensitivity is. With respect to the index (γ) for showing the contrast of an image, a point giving fog+density of 0.3 in a characteristic curve and a point giving fog+density of 3.0 were connected by a straight line and the gradient of the straight line was shown as the γ value. In other words, γ=(3.0−0.3)/[log(exposure amount necessary for giving density of 3.0)−log(exposure amount necessary for giving density of 0.3)], and the larger the γ value is, the higher the contrast is.

(2-2) Evaluation of Safelight Immunity

Light of 40 Lux was illuminated using SLF-1B (safelight for yellow light) manufactured by Fuji Photo Film Co., Ltd. and the time until the fog increased by 0.11 ogE was determined. The larger the value is, the better the safelight immunity is.

(2-3) Evaluation of Black Pepper

The black pepper was evaluated according to 5-rank rating by observing the expression area through a microscope, and "5" indicates the highest level where black pepper was not generated at all and "1" indicates the lowest quality where black pepper was generated tremendously. The rank "3" is a limiting level where the generation of black pepper is tolerable in practical use.

(2-4) Evaluation of Running Stability

The processing and the evaluation were conducted in the same manner as in (2-1) Evaluation of Photographic Capability except for using the following Exhausted Developer 1 or 2 in place of Developer A.

Exhausted Developer 1

A sample having a blacking ratio of 80% was processed with Developer A at a processing rate of 50 $m^2$ per day while replenishing the developer in an amount of 160 ml/$m^2$ using an automatic developing machine FG-680A manufactured by Fuji Photo Film Co., Ltd. and the developer after running until 300 $m^2$ in total of sample was processed was used as Exhausted Developer 1.

Exhausted Developer 2

A sample having a blacking ratio of 20% was processed with Developer A at a processing rate of 5 $m^2$ per day while replenishing the developer in an amount of 160 ml/$m^2$ using an automatic developing machine FG-680A and the developer after running until 300 $m^2$ in total of sample was processed was used as Exhausted Developer 2.

(2-5) Evaluation of Storage Stability

The samples prepared above each was allowed to stand under conditions of 50° C. and 40% RH or of 60° C. and 65% RH, for 3 days and then the photographic properties were evaluated in the same conditions as in the above item (2-1). The change in sensitivity is shown by a variation from the sensitivity, taken as 100, of a sample aged at normal temperature for 3 days.

Developer B:

| | |
|---|---|
| Potassium hydroxide | 35.0 g |
| Diethylenetriaminepentaacetic acid | 2.0 g |
| Sodium metabisulfate | 54.0 q |
| Potassium carbonate | 100.0 g |
| Potassium bromide | 3.0 g |
| 5-Methylbenzotriazole | 0.08 g |
| 2,3,5,6,7,8-Hexahydro-2-thioxo-4-(1H)-quinazoline | 0.03 g |
| Sodium 2-Mercaptobenzimidazole-5-sulfonate | 0.15 g |
| Hydroquinone | 30.0 g |
| 4-Hydroxymethyl-4-methyl-1-phenyl-3-pyrazolidone | 0.45 g |
| Sodium erythorbate | 3.0 g |

Potassium hydroxide and water were added to make 1 l and pH adjusted to 10.5

Developer C:

| | |
|---|---|
| Potassium hydroxide | 10.0 g |
| Diethylenetriaminepentaacetic acid | 1.5 g |
| Potassium carbonate | 15.0 g |
| Potassium bromide | 3.0 g |
| 5-Methylbenzotriazole | 0.10 g |
| 1-Phenyl-5-mercaptotetrazole | 0.02 g |
| Potassium sulfite | 10.0 g |

TABLE 3

| | | | Developer | | | Exhausted Developer 1 | | | Exausted Developer 2 | | | Storage Stability | | |
|---|---|---|---|---|---|---|---|---|---|---|---|---|---|---|
| No. | Emulsion | Sensitivity | γ | Black Pepper | Safelight | Sensitivity | γ | Black Pepper | Sensitivity | γ | Black Pepper | Sensitivity | γ | Remarks |
| 13 | A | 185 | 18 | 2 | >20 | 152 | 14 | 3 | 196 | 20 | 1 | +5 | 18 | Comparison |
| 14 | B | 150 | 19 | 4 | >20 | 120 | 15 | 5 | 160 | 21 | 4 | +5 | 19 | " |
| 15 | C | 140 | 20 | 5 | >20 | 115 | 16 | 5 | 150 | 22 | 5 | +5 | 20 | " |
| 16 | D | 135 | 20 | 5 | 10 | 120 | 16 | 5 | 145 | 22 | 5 | +28 | 16 | " |
| 17 | E | 95 | 21 | 5 | 8 | 75 | 18 | 5 | 103 | 23 | 5 | +42 | 17 | " |
| 18 | F | 160 | 20 | 5 | >20 | 138 | 18 | 5 | 167 | 21 | 5 | +5 | 20 | Invention |
| 19 | G | 140 | 21 | 5 | 20 | 120 | 19 | 5 | 147 | 22 | 5 | +5 | 21 | " |
| 20 | H | 120 | 22 | 5 | 20 | 103 | 20 | 5 | 126 | 23 | 5 | +6 | 22 | " |
| 21 | I | 130 | 21 | 5 | 20 | 110 | 19 | 5 | 137 | 22 | 5 | +6 | 21 | " |
| 22 | J | 125 | 21 | 5 | 20 | 115 | 19 | 5 | 132 | 22 | 5 | +6 | 21 | " |
| 23 | K | 165 | 20 | 5 | >20 | 140 | 18 | 5 | 173 | 21 | 5 | +5 | 20 | " |
| 24 | L | 155 | 20 | 5 | >20 | 135 | 18 | 5 | 163 | 21 | 5 | +5 | 20 | " |

Results

From the comparison of Example 1 with Example 2, it is seen that samples using an emulsion having a large γ value in Example 1 (containing no hydrazine derivative) exhibit a higher γ value in Example 2 (containing hydrazine). Also, in the case of processing with Exhausted Developer 1 or 2, the change in sensitivity and the change in the γ value are small.

In other words, it is verified that according to the present invention, a high-sensitive and high-contrast photographic material excellent in the safelight immunity, undergoing small change in the sensitivity and the tone value even when processed with an exhausted developer, and reduced in the change in the capabilities after enforced storage can be obtained.

EXAMPLE 3

The photographic materials prepared in Examples 1 and 2 each was developed under the conditions in Examples 1 and 2 using the following Developer B or C in place of Developer A used in Examples 1 and 2.

-continued

| | |
|---|---|
| Sodium 2-mercaptobenzimidazole-5-sulfonate | 0.15 g |
| 4-Hydroxymethyl-4-methyl-1-phenyl-3-pyrazolidone | 0.40 g |
| Sodium erythorbate | 30.0 g |

Potassium hydroxide and water were added to make 1 l and pH adjusted to 10.7

Developer B was prepared using a processing agent stored in the form of solid.

The solid processing agent was produced by packing ingredients of a developer formed into a solid laminate in a bag formed of a plastic material coated with an aluminum foil. The order of layers in laminating was as follows from the upper side:

| | |
|---|---|
| First layer | hydroquinone |
| Second layer | other ingredients |
| Third layer | sodium bisulfite |

-continued

| | |
|---|---|
| Fourth layer | potassium carbonate |
| Fifth layer | potassium hydroxide pellets |

The bag was evacuated according to a usual method to vacuumize the system and sealed.

Results

Similar results to those in Examples 1 and 2 were obtained even when Developer B or C was used.

EXAMPLE 4

Samples of Examples 1 and 2 each was coated on a support of which both surfaces were undercoated, described in JP-A-7-234478, and evaluated under the conditions of Example 1, 2 or 3.

Results

Similarly to Examples 1, 2 and 3, good results can be obtained using samples of the present invention.

Reference Example 1

Preparation of Emulsion

Emulsion M

To a 1.5% aqueous gelatin solution kept at 40° C., containing sodium chloride and having a pH of 2.0, an aqueous silver nitrate solution and an aqueous sodium chloride solution containing $1.5\times10^{-6}$ mol/mol-Ag of $(NH_4)_2Rh(H_2O)Cl_5$ were added simultaneously by a double jet method at an electric potential of 95 mV over 3 minutes and 30 seconds to use a half of the silver amount of a final grain to therey prepare core grains each having a size of 0.12 μm. Thereafter, an aqueous silver nitrate solution and an aqueous sodium chloride solution containing $4.5\times10^{-6}$ mol/mol-Ag of $(NH_4)_2Rh(H_2O)Cl_5$ were added in the same manner as above over 7 minutes to prepare silver chloride cubic grains having an average grain size of 0.15 μm (coefficient of variation: 12%).

Then, thereto $1.5\times10^{-3}$ mol/mol-Ag of 4-hydroxy-6-methyl-1,3,3a,7-tetrazaindene was added.

Further, the emulsion was washed with water by a flocculation method well known in the art to remove soluble salts, then gelatin was added and without subjecting the emulsion to chemical sensitization, 50 mg/mol-Ag of Compound (i) and 50 mg/mol-Ag of phenoxyethanol as antiseptics, and $1.5\times10^{-3}$ mol/mol-Ag of 4-hydroxy-6-methyl-1,3,3a,7-tetrazaindene as a stabilizer were added (as a final grain, pH=5.7, pAg=7.5, Rh=$3.0\times10^{-6}$ mol/mol-Ag).

Emulsion P

Emulsion P was prepared in the same manner as Emulsion M except for using $7.0\times10^{-6}$ mol/mol-Ag of $K_3[Cr(CN)_6]$ (doping ratio of core:shell=1:3) in place of $(NH_4)_2Rh(H_2O)Cl_5$ of Emulsion M.

Emulsion Q

To a 1.5% aqueous gelatin solution kept at 40° C., containing sodium chloride and having a pH of 4.0, an aqueous silver nitrate solution and an aqueous sodium chloride solution containing $3.5\times10^{-6}$ mol/mol-Ag of $K_3[Cr(CN)_6]$ were added simultaneously by a double jet method at an electric potential of 95 mV over 3 minutes and 30 seconds to use a half of the silver amount of a final grain to therey prepare core grains each having a size of 0.12 μm. Thereafter, an aqueous silver nitrate solution and an aqueous sodium chloride solution containing $10.5\times10^{-6}$ mol/mol-Ag of $K_3[Cr(CN)_6]$ were added in the same manner as above over 7 minutes to prepare silver chloride cubic grains having an average grain size of 0.15 μm (coefficient of variation: 12%).

The remaining process was conducted in the same manner as in Emulsion M and grains containing $7\times10^{-6}$ mol/mol-Ag of $K_3[Cr(CN)_6]$ were finally prepared.

Emulsion R

Emulsion R was prepared in the same manner as Emulsion Q except for changing the pH at the time of feeding to 6.5 in the preparation of Emulsion Q.

Emulsion S

To a 1.5% aqueous gelatin solution kept at 40° C., containing sodium chloride and $3\times10^{-5}$ mol/mol-Ag of Compound (2-2), and having a pH of 4.0, an aqueous silver nitrate solution and an aqueous sodium chloride solution containing $3.5\times10^{-6}$ mol/mol-Ag of $K_3[Cr(CN)_6]$ were added simultaneously by a double jet method at an electric potential of 95 mV over 3 minutes and 30 seconds to use a half of the silver amount of a final grain to therey prepare core grains each having a size of 0.12 μm. Thereafter, an aqueous silver nitrate solution and an aqueous sodium chloride solution containing $10.5\times10^{-6}$ mol/mol-Ag of $K_3[Cr(CN)_6]$ were added in the same manner as above over 7 minutes to prepare silver chloride cubic grains having an average grain size of 0.15 μm (coefficient of variation: 12%).

The remaining process was conducted in the same manner as in Emulsion M and grains containing $7\times10^{-6}$ mol/mol-Ag of $K_3[Cr(CN)_6]$ were finally obtained.

Emulsion T

Emulsion T was prepared in the same manner as Emulsion S except for changing the pH at the time of feeding to 6.5 and using Compound (2-16) in the preparation of Emulsion S.

Emulsion U

To a 1.5% aqueous gelatin solution kept at 40° C., containing sodium chloride and $3\times10^{-5}$ mol/mol-Ag of Compound (2-16), and having a pH of 6.5, an aqueous silver nitrate solution and an aqueous sodium chloride solution were added simultaneously by a double jet method at an electric potential of 95 mV over 3 minutes and 30 seconds to use a half of the silver amount of a final grain to therey prepare core grains each having a size of 0.12 μm. Thereafter, an aqueous silver nitrate solution and an aqueous sodium chloride solution containing $14.0\times10^{-6}$ mol/mol-Ag of $K_3[Cr(CN)_6]$ were added in the same manner as above over 7 minutes to prepare silver chloride cubic grains having an average grain size of 0.15 μm (coefficient of variation: 12%).

The remaining process was conducted in the same manner as in Emulsion M and grains containing $7\times10^{-6}$ mol/mol-Ag of $K_3[Cr(CN)_6]$ were finally obtained.

Emulsion V

Core grains (size: 0.12 μm) were prepared in the same manner as in Emulsion G. Thereafter, an aqueous silver nitrate solution and an aqueous sodium chloride solution containing $28.0\times10^{-6}$ mol/mol-Ag of $K_3[Cr(CN)_6]$ and $1\times10^{-5}$ mol/mol-Ag of Compound (2-16) were added in the same manner as above over 7 minutes to use a quarter (¼) of the silver amount of a final grain to thereby prepare grains each having a size of 0.14 μm. Further, an aqueous silver nitrate solution and an aqueous sodium chloride solution were added in the same manner as above over 3 minutes and 30 seconds to use a quarter of the silver amount of a final grain to thereby prepare grains each having a size of 0.15 μm (coefficient of variation: 13%)

The remaining process was conducted in the same manner as in Emulsion M and grains containing $7\times10^{-6}$ mol/mol-Ag of $K_3[Cr(CN)_6]$ were finally obtained.

Emulsion W

Emulsion W was prepared in the same manner as Emulsion U except for changing the doping amount of $K_3[Cr$ $(CN)_6]$ to $9\times10^{-6}$ mol/mol-Ag (the doping site in the grain was the same) in the preparation of Emulsion U.

Emulsion X

Emulsion X was prepared in the same manner as Emulsion V except for changing the doping amount of $K_3[Cr(CN)_6]$ to $8.5\times10^{-6}$ mol/mol-Ag (the doping site in the in the preparation of Emulsion V.

Preparation of Coating Solution For Emulsion Layer and Coating Thereof

The following compounds were added to each of emulsions shown in Table 201 and a silver halide emulsion layer was coated on a support described below having an undercoat layer to give a gelatin coated amount of 0.9 g/m$^2$ and a silver coated amount of 2.5 g/m$^2$.

| | |
|---|---|
| 4-Hydroxy-6-methyl-1,3,3a,7-tetrazaindene | 10 mg/m$^2$ |
| Sodium N-oleyl-N-methyltaurine | 35 mg/m$^2$ |
| Compound-(b') | 10 mg/m$^2$ |
| Compound-(c') | 20 mg/m$^2$ |
| n-Butylacrylate/2-acetoacetoxyethyl methacrylate/acrylic acid copolymer (89/8/3) | 900 mg/m$^2$ |
| Compound-(d') (hardening agent) | 150 mg/m$^2$ |

On the upper layer of the above-described emulsion layer, emulsion protective lower and upper layers were coated.

Preparation of Coating Solution for Emulsion Protective Lower Layer and Coating Thereof The following compounds were added to an aqueous gelatin solution and coated to give a gelatin coated amount of 0.9 g/m$^2$.

| | |
|---|---|
| Gelatin ($Ca^{++}$ content: 2,700 ppm) | 0.7 g/m$^2$ |
| Sodium p-dodecylbenzenesulfonate | 15 mg/m$^2$ |
| Compound-(a') | 5 mg/m$^2$ |
| Compound-(e') | 10 mg/m$^2$ |
| Compound-( f') | 20 mg/m$^2$ |

Preparation of Coating Solution for Emulsion Protective Upper Layer and Coating Thereof The following compounds were added to an aqueous gelatin solution and coated to give a gelatin coated amount of 0.5 g/m$^2$.

| | |
|---|---|
| Gelatin ($Ca^{++}$ content: 2,700 ppm) | 0.8 g/m$^2$ |
| Amorphous silica matting agent (average particle size: 3.5 μm, pore diameter: 25 Å, surface area: 700 m$^2$/g) | 40 mg/m$^2$ |
| Amorphous silica matting agent (average particle size: 2.5 μm, pore diameter: 170 Å, surface area: 300 m$^2$/g) | 10 mg/m$^2$ |
| Potassium N-perfluorooctanesulfonyl-N-propylglycine | 5 mg/m$^2$ |
| Sodium dodecylbenzenesulfonate | 30 mg/m$^2$ |
| Compound-(a') | 5 mg/m$^2$ |
| Compound-(g') | 20 mg/m$^2$ |
| Solid Disperse Dye-$G_1$ | 100 mg/m$^2$ |
| Solid Disperse Dye-$G_2$ | 50 mg/m$^2$ |

Then, on the opposite side of the support, the following electroconductive layer and backing layer were simultaneously coated.

Preparation of Coating Solution for Electroconductive Layer and Coating Thereof

The following compounds were added to an aqueous gelatin solution and coated to give a gelatin coated amount of 77 mg/m$^2$.

| | |
|---|---|
| $SnO_2$/Sb (9/1 by weight, average particle size: 0.25 μm) | 200 mg/m$^2$ |
| Gelatin ($Ca^{++}$ content: 3,000 ppm) | 77 mg/m$^2$ |
| Sodium dodecylbenzenesulfonate | 10 mg/m$^2$ |
| Sodium dihexyl-α-sulfosuccinate | 40 mg/m$^2$ |
| Sodium polystyrenesulfonate | 9 mg/m$^2$ |
| Compound-(a') | 7 mg/m$^2$ |

Preparation of Coating Solution for Back Layer and Coating Thereof

The following compounds were added to an aqueous gelatin solution and coated to give a gelatin coated amount of 2.22 g/m$^2$.

| | |
|---|---|
| Gelatin ($Ca^{++}$ content: 30 ppm) | 2.92 g/m$^2$ |
| Polymethyl methacrylate fine particle (average particle size: 3.4 μm) | 54 mg/m$^2$ |
| Dye [a'] | 140 mg/m$^2$ |
| Dye [b'] | 140 mg/m$^2$ |
| Dye [c'] | 40 mg/m$^2$ |
| Sodium dodecylbenzenesulfonate | 75 mg/m$^2$ |
| Sodium dihexyl-α-sulfosuccinate | 20 mg/m$^2$ |
| Compound-(h') | 5 mg/m$^2$ |
| N-Perfluorooctanesulfonyl-N-propylglycine potassium | 5 mg/m$^2$ |
| Sodium sulfate | 50 mg/m$^2$ |
| Sodium acetate | 85 mg/m$^2$ |

Support and Undercoat Layer

A first undercoat layer and a second undercoat layer each having the following composition were coated on both surfaces of a biaxially stretched polyethylene terephthalate support (thickness: 100 μm).

Undercoat First Layer

| | |
|---|---|
| Core-shell type vinylidene chloride copolymer (1) | 15 g |
| 2,4-Dichloro-6-hydroxy-s-triazine | 0.25 g |
| Polystyrene fine particle (average particle size: 3 μm) | 0.05 g |
| Compound-(i') | 0.20 g |
| Colloidal silica (Snowtex ZL, produced by Nissan Kagaku KK, particle size: 70 to 100 μm) | 0.12 g |
| Water to make | 100 g |

Further, 10 wt % of KOH was added thereto and the resulting coating solution adjusted to have a pH of 6 was coated at a drying temperature of 180° C. for 2 minutes to give a dry thickness of 0.9 μm.

Undercoat Second Layer

| | |
|---|---|
| Gelatin | 1 g |
| Methyl cellulose | 0.05 g |
| Compound-(j') | 0.02 g |
| $C_{12}H_{25}O(CH_2CH_2O)_{10}H$ | 0.03 g |
| Compound-(a') | $3.5\times10^{-3}$ g |
| Acetic acid | 0.2 g |
| Water to make | 100 g |

The resulting coating solution was coated at a drying temperature of 170° C. within 2 minutes to give a dry thickness of 0.1 μm. Thus, Samples 1 to 15 were prepared.

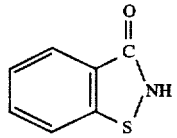

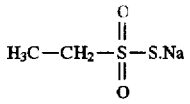

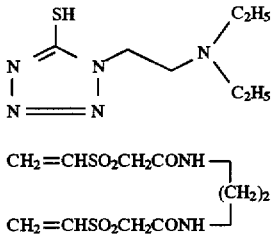

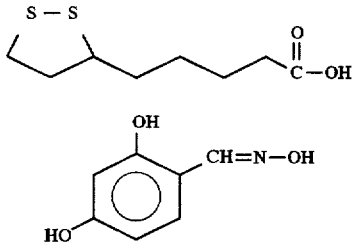

Solid Disperse Dye-$G_1$

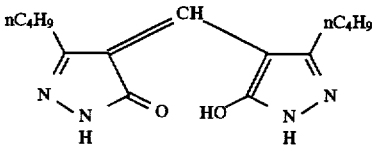

Solid disperse Dye-$G_2$

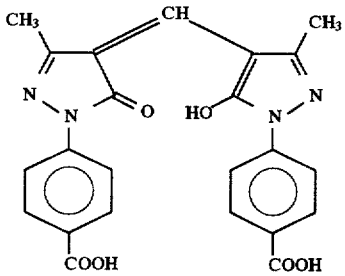

$C_8F_{17}SO_2Li$ (h')

$C_8F_{17}SO_2NCH_2COOK$ (g')
$C_3H_7$

Dye [a']

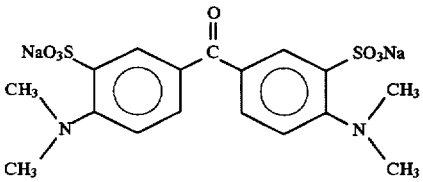

-continued (a')

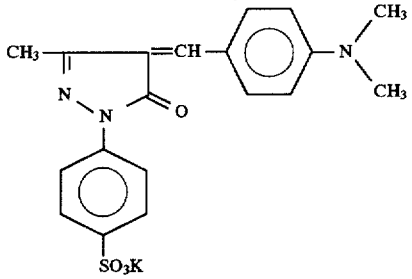

Dye [b']

(b')

(c')

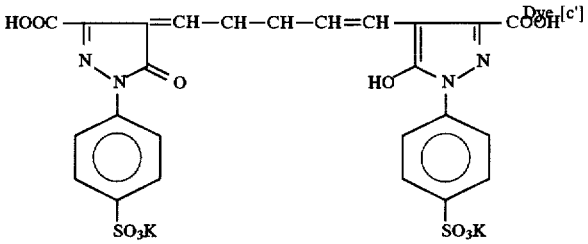

Dye [c']

(d')

(e')

Core-shell-type vinylidene chloride copolymer (1)

(f')

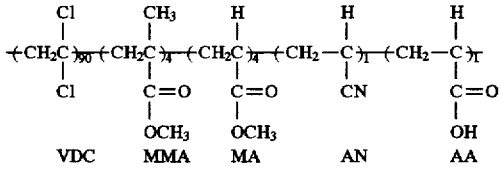

VDC MMA MA AN AA

Core: VDC/MMA/MA (80 wt %)
Shell: VDC/AN/AA (20 wt %)
Average grain size: 70 nm (i')

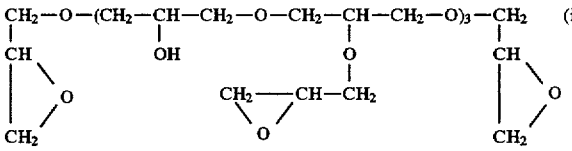

(j')

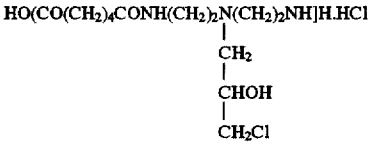

Evaluation Method (1) Evaluation of Photographic Properties

Each of the thus-obtained samples was exposed through an optical wedge in a printer, FPA-800FX (Low mode), manufactured by Fuji Photo Film Co., Ltd., processed with Developer A described below at 38° C. for 20 seconds in an automatic developing machine, FG-680AG, manufactured by Fuji Photo Film Co., Ltd., and then fixed, water washed and dried. The fixing solution used was Fixing Solution A described below. The resulting samples were evaluated on the following items:

1) Sensitivity ($S_{1.5}$): A logarithmic value of the exposure amount necessary for giving density of 1.5 (the smaller the value is, the higher the sensitivity is)

2) γ: (3.0−0.1)/{log(exposure amount necessary for giving density of 3.0)−log(exposure amount necessary for giving density of 0.1)}

(2) Dmax in Practical Use

A halftone original for dot-to-dot working was prepared by fixing a film (halftone original) having formed thereon a halftone image to a paste-in base by means of an adhesion tape. Each film sample was put into contact therewith so that the protective layer came into close contact face-to-face with the halftone original and exposed and processed in a printer in the same manner as above so that a dot area of 50% gave a dot area of 50% on the film sample. The maximum blacking density on the thus-processed sample is defined as Dmax.

(3) Fog after Long-Term Storage

Each sample was allowed to stand under conditions of 60° C. and 30% for 10 days and without being exposed, subjected to development, fixing, water washing and drying. Five sheets of samples were superposed and the fog was measured. The results obtained were compared for evaluation with the fog measured on samples immediately after the same processing.

The change in fog was evaluated according to the following formula:

Δfog=fog (after storage at 60° C. and 30% for 10 days)−fog (immediately after coating)

| Developer A' | |
|---|---|
| Potassium hydroxide | 35.0 g |
| Diethylenetriaminepentaacetic acid | 2.0 g |
| Potassium carbonate | 12.0 g |
| Sodium metabisulfate | 40.0 g |
| Potassium bromide | 3.0 g |
| Hydroquinone | 25.0 g |
| 5-Methylbenzotriazole | 0.08 g |
| 4-Hydroxymethyl-4-methyl-1-phenyl-3-pyrazolidone | 0.45 g |
| 2,3,5,6,7,8-Hexahydro-2-thioxo-4-(1H)-quinazolinone | 0.04 g |
| Sodium 2-mercaptobenzimidazole-5-sulfonate | 0.15 g |
| Sodium erythorbate | 3.0 g |
| Potassium hydroxide and water were added to make 1 l and the pH was adjusted to 10.5. | |
| **Fixing Solution A'** | |
| Ammonium thiosulfate | 359.1 g |
| Disodium ethyleneaminetetraacetate dihydrate | 2.26 g |
| Sodium thiosulfate pentahydrate | 32.8 g |
| Sodium sulfite | 64.8 g |
| NaOH | 37.2 g |
| Glacial acetic acid | 87.3 g |
| Tartaric acid | 8.76 g |
| Sodium gluconate | 6.6 g |
| Aluminum sulfate | 25.3 g |
| pH (adjusted by sulfuric acid or sodium hydroxide) | 4.85 g |
| Water to make | 1 l |

Two l of water were added per l of the fixing solution before use.

TABLE 201

| Sample | | Photographic Properties | | Practical Use | Storage Stability |
|---|---|---|---|---|---|
| No. | Emulsion | Sensitivity | γ | Dmax | Δfog |
| 1 | M | 2.42 | 7.6 | 4.45 | +0.04 |
| 2 | P | 2.15 | 6.2 | 4.37 | +0.10 |
| 3 | Q | 2.50 | 8.6 | 4.76 | +0.24 |
| 4 | R | 2.52 | 9.3 | 4.89 | +0.35 |
| 5 | S | 2.50 | 8.7 | 4.95 | +0.02 |
| 6 | T | 2.51 | 9.3 | 5.11 | +0.03 |

TABLE 201-continued

| Sample | | Photographic Properties | | Practical Use | Storage Stability |
|---|---|---|---|---|---|
| No. | Emulsion | Sensitivity | γ | Dmax | Δfog |
| 7 | U | 2.45 | 9.6 | 5.11 | +0.02 |
| 8 | V | 2.42 | 9.8 | 5.15 | +0.02 |
| 9 | W | 2.62 | 9.5 | 5.10 | +0.03 |
| 10 | X | 2.59 | 9.8 | 5.10 | +0.03 |

As clear from the results shown in Table 201, the sample containing a cyanochromate ion have low fog after long-term storage, high contrast, and high practical use Dmax.

Moreover, the samples have higher contrast and higher practical use Dmax than the samples containing a rhodium salt which have been ordinary used.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one silver halide emulsion layer, wherein the silver halide emulsion comprises silver halide grains having a silver chloride content of 50 mol % or more, and the silver halide grain contain a cyanochromium complex ion represented by the following formula (I) and at least one complex of a metal selected from rhodium, ruthenium, osmium, rhenium and iron:

$$[Cr(CN)_{6-n}L_n]^{m-} \quad (I)$$

wherein L represents $H_2O$ or OH; n represents 0 or 1; and m represents 3 or 4.

2. The silver halide photographic material as claimed in claim 1, wherein at least one layer of the silver halide emulsion layer(s) and other hydrophilic colloid layer contains at least one hydrazine derivative.

3. The silver halide photographic material as claimed in claim 1, wherein the silver halide grain contains rhodium.

4. The silver halide photographic material as claimed in claim 1, wherein the silver halide grains contain ruthenium.

5. The silver halide photographic material as claimed in claim 1, wherein the silver halide grains contain osmium.

6. The silver halide photographic material as claimed in claim 1, wherein the silver halide grains contain rhenium.

7. The silver halide photographic material as claimed in claim 1, wherein the silver halide grains contain iron.

8. The silver halide photographic material as claimed in claim 1, wherein the cyanochromium complex is present in a doping amount of from $1\times10^{-8}$ to $1\times10^{-2}$ mol per mol of silver halide.

9. The silver halide photographic material as claimed in claim 1, wherein the metal complex content is from $1\times10^{-9}$ to $1\times10^{-2}$ mol/mol-Ag.

10. The silver halide photographic material as claimed in claim 1, wherein n is 0.

11. The silver halide photographic material as claimed in claim 1, wherein n is 1.

* * * * *